US009403585B2

(12) United States Patent
Arad

(10) Patent No.: US 9,403,585 B2
(45) Date of Patent: Aug. 2, 2016

(54) ELLIPTICAL HUMAN-POWERED WATERCRAFT

(71) Applicant: Uriel Arad, Sherman Oaks, CA (US)

(72) Inventor: Uriel Arad, Sherman Oaks, CA (US)

( * ) Notice: Subject to any disclaimer, the term of this patent is extended or adjusted under 35 U.S.C. 154(b) by 0 days.

(21) Appl. No.: 14/475,561

(22) Filed: Sep. 2, 2014

(65) Prior Publication Data

US 2016/0059945 A1 Mar. 3, 2016

Related U.S. Application Data

(60) Provisional application No. 61/959,693, filed on Aug. 30, 2013.

(51) Int. Cl.

| | |
|---|---|
| ***B63H 16/00*** | (2006.01) |
| ***B63H 16/20*** | (2006.01) |
| ***B63H 16/18*** | (2006.01) |
| ***B63H 5/15*** | (2006.01) |
| ***B63B 1/12*** | (2006.01) |
| ***B63H 25/02*** | (2006.01) |
| ***B63H 23/06*** | (2006.01) |

(52) U.S. Cl.

CPC *B63H 5/15* (2013.01); *B63B 1/121* (2013.01); *B63H 16/18* (2013.01); *B63H 16/20* (2013.01); *B63H 23/06* (2013.01); *B63H 25/02* (2013.01); *B63H 2016/202* (2013.01); *B63H 2025/024* (2013.01)

(58) Field of Classification Search

CPC ..... B63H 16/00; B63H 16/02; B63H 16/08; B63H 2016/085; B63H 16/12; B63H 16/18; B63H 16/20; B63H 2016/202

USPC ..... 440/21, 26, 28, 31, 67, 71, 82

See application file for complete search history.

(56) References Cited

U.S. PATENT DOCUMENTS

| | | | | |
|---|---|---|---|---|
| 3,084,356 | A | 4/1963 | Wheat | |
| 3,528,382 | A * | 9/1970 | Corlett | B63H 1/28 114/162 |
| 3,695,211 | A | 10/1972 | Gross | |
| 4,172,427 | A | 10/1979 | Kindred | |
| 5,090,928 | A | 2/1992 | Rybczyck | |
| 5,098,085 | A | 3/1992 | Abboudi et al. | |

(Continued)

OTHER PUBLICATIONS http://en.wikipedia.org/wiki/human-powered_hydrofoil.

(Continued)

*Primary Examiner* — Anthony Wiest

(57) ABSTRACT

A one-person watercraft, with a unique design and basic innovative modular catamaran style structure that makes the craft transformable, and useful for different hybrid water sports. The watercraft enables the user to either stand or sit while providing power to the craft. The craft comes in multiple versions, and the user may provide power to the craft through elliptical movement, hand-driven levers or foot-driven pedals/skis while standing up and/or sitting down and moving in an elliptical motion. These turn a propeller, at the back of the craft. Embodiments of the craft utilize the Venturi effect (with a flexible drive shaft and a retractable propeller rudder system) to increase the propulsion created by water flowing through the propeller. The craft is designed to float stably to ensure users' safety, and may be used for leisure recreational activity, exercise, physical rehabilitation, transportation to travel across water, or any combination of the above.

14 Claims, 28 Drawing Sheets

(56) References Cited

U.S. PATENT DOCUMENTS

| | | | | |
|---|---|---|---|---|
| 5,123,641 | A | 6/1992 | Abboudi et al. | |
| 5,163,857 | A | 11/1992 | Hinsley | |
| 5,433,680 | A | 7/1995 | Knudsen | |
| 5,558,604 | A | 9/1996 | Hopkins | |
| 5,860,378 | A | 1/1999 | Schaller | |
| 5,868,649 | A | 2/1999 | Erickson et al. | |
| 6,007,462 | A | 12/1999 | Chen | |
| 6,135,835 | A | 10/2000 | Lekhtman | |
| 6,165,029 | A * | 12/2000 | Lu | B63H 11/113 440/30 |
| 6,290,629 | B1 | 9/2001 | Vargas et al. | |
| 6,490,989 | B1 | 12/2002 | Ray | |
| 6,595,813 | B1 | 7/2003 | Lekhtman | |
| 7,371,138 | B2 | 5/2008 | Spass | |
| 7,481,745 | B2 | 1/2009 | Malazinksey | |
| 7,607,959 | B2 | 10/2009 | DeMint | |
| 8,043,134 | B2 | 10/2011 | Krah | |
| 8,074,304 | B1 | 12/2011 | Snyder | |
| 8,167,667 | B2 | 5/2012 | Sturm | |
| 8,408,954 | B2 | 4/2013 | Sturm | |
| 9,051,038 | B1 * | 6/2015 | Herber | B63H 16/20 |
| 2003/0024456 | A1 | 2/2003 | Swetish | |

OTHER PUBLICATIONS http://en.wikipedia.org/wiki/pedalo.
http://en.wikipedia.org/wiki/hydrocycle.
http://lancet.mit.edu/decavitator.
http://www.human-powered-hydrofoils.com/hydrofoils/aquaskipper.

* cited by examiner

ELLIPTICAL HUMAN-POWERED WATERCRAFT

DESCRIPTION OF THE RELATED ART

Different kinds of watercraft have been known for thousands of years. Most boats have used sailing or some other artificial form of propulsion. Human-powered boats have also been known for thousands of years, and have generally used oars.

Recreational human-powered watercraft are used on a large scale in coastal areas, and also are often used for exercise. The exercise results from the user employing his or her physical strength to provide motive power for the watercraft. Recreational human-powered watercraft are used on a smaller scale for transportation, in the United States, and are used on a larger scale, for transportation, in other countries. Examples of recreational human-powered watercraft include, but are not limited to, kayaks, rowboats, and pedal boats. These all carry additional benefits, in that they provide the user with physical exercise. However, a need does exist for other types of recreational watercraft, which can provide the user with different types of physical exercise not currently provided by watercraft of the types presently available. "Pedalboats", which are powered by the user(s) pedaling with their feet, also exist, but these are inefficient at converting the physical energy expended by the user into motive power, and pedalboats are relatively slow. Furthermore, both pedalboats and rowboats suffer from the problem that, if a user stands up in the boat, the boat may capsize.

To propel a boat by using oars, though, the users must use their arms to exert pressure on the oars. This creates a long-term risk of damage to the user's back, and also creates fatigue for the user. Furthermore, if a rower loses the oars, it may become impossible to steer, and very hard to move, an oarpowered craft. In addition, a user generally needs to commit his or her hands and arms to rowing, in order to power an oar powered craft. Thus, the user's hands and arms are not available for other purposes.

A new innovative type of recreational watercraft is needed, as there are changes in designs and styles of recreational equipment both on land, as well as on water. The elliptical cross trainer is a newer revolutionary exercise device that has been around for less than 20 years. Recently, the elliptical machine has moved from being stationary in the gym to becoming mobile and utilized outdoors by two different types of elliptical bicycles which are now available. A decade ago almost no one had ever heard of stand-up paddle boarding (SUP), but now stand up paddle boarding is one of the fastest growing water sports in the world, with its origins coming from surfing. These new innovative designs in sports equipment allow more people to try different varieties of exercise equipment for both health and enjoyment. Americans need to increase the amount of physical exercise that they participate in, in order to combat the obesity epidemic in the United States.

Rehabilitative therapy sometimes involves swimming, walking through water, or other water activities. The resistance provided by the water makes the therapy more effective. Rehabilitative therapy may also involve other repetitive motions such as the user pedaling with his hands or feet. A need exists for a water vehicle that can provide the benefits of multiple types of rehabilitative therapy to the user, and allows the user to switch between these types as necessary.

In terms of transportation both in the US and abroad, conservation of fossil fuels and energy is generally important. Therefore the need for watercraft that are not powered by fossil fuels has increased. A need exists for a new type of human-powered watercraft that includes a system for increasing the amount of motive power available to the craft, without the use of fossil fuels.

Businesses such as resorts and exercise clubs also have a need for a type of human-powered watercraft that they can offer to clients, on the basis of hourly or daily rental. Such human-powered watercraft may be particularly useful in shallow areas such as lagoons.

In summary, a need exists for a new type of innovative recreational human-powered watercraft that can be used for transportation, for exercise, and leisure without the shortcomings of previous inventions in the field. This human-powered watercraft (Aqua Elliptica) which is a combination of an elliptical machine and stand up paddle incorporates the benefits of a low impact cross training cardiovascular workout with the joy of nature and the thrill of the fastest growing water sport, SUP. This human powered watercraft is attractive to the user and provides the user(s) with the opportunity to exercise different muscle groups without fear of injury, in an outdoor environment on the water.

The Venturi Effect

The Venturi Effect has been known since 1797. The Venturi Effect is that, as a fluid passes through a constricted tube, the fluid's velocity must increase, and its pressure must decrease. The equation governing this is as follows:

$$p_1-p_2=d/2((v_2)^2-(v_1)^2)$$

Where $p_1$ is the fluid pressure at the wider opening, $p_2$ is the fluid pressure at the narrower opening, d is the density of the fluid, $v_2$ is the fluid velocity when the pipe is narrower, and $v_1$ is the fluid velocity when the pipe is wider.

The Venturi effect can be used to increase the speed of a boat or other watercraft, which is connected to a constricted tube, because of the increase in velocity and decrease in pressure of the water as it passes through the tube. Some hydrofoil boats use the Venturi effect to increase their speed. No human-powered watercraft, before the present invention, has made use of the Venturi effect. This is another reason why the present invention represents a significant advance in the field of human-powered watercraft.

The method through which hydrofoil boats use the Venturi effect is different from the method through which the present invention uses the Venturi effect. The present invention utilizes a propeller, in a constricted tube, to take advantage of the Venturi effect. The design of the present invention forces water to flow through the constricted tube, and the differences in width of the tube affect the velocity of the water flowing through the tube, so that the speed of the invention through the surrounding water is increased. This is different from the method used in hydrofoils.

Human-powered hydrofoils are, notably the fastest type of human-powered boats. However, no human-powered hydrofoil appears to exist, which utilizes the Venturi effect. Furthermore, most human-powered hydrofoils will sink if they are not propelled at a certain minimum speed. The present invention does not have this drawback. It is designed with floating members (2), so it can continue to float, even if motionless.

Hydrocycles, which use pedals to turn a propeller, also exist, but no hydrocycle exists which utilizes the Venturi effect in the same way as the present invention.

The "pedalo" is a type of paddle-boat which uses pedals to power paddle-wheels. This configuration is fundamentally different from the present invention. The present invention uses pedals to power a propeller, which provides propulsion. Furthermore, the present invention is lighter than most versions of the pedalo, and provides exercise to more of the user's muscle groups.

The "Decavitator" is a human-powered hydrofoil that was invented by researchers at the Massachusetts Institute of Technology in 1990. It operates on different principles from the present invention. The human pilot of the Decavitator is enclosed in a "cockpit" and the Decavitator appears to provide propulsion through a very large propeller that turns in the air, not the water. The Decavitator does not appear to utilize the Venturi Effect. The Decavitator also appears to not be designed as an exercise device. This is in contrast to the present invention, which was designed, in part, to provide exercise to a large number of the user's muscle groups.

A need exists for a new type of human-powered watercraft that is more stable, is lighter, can be used for exercise of a large number the user's muscle groups, creates less fatigue for the user's arms, allows the user to use his or her arms for other purposes besides powering the craft, and takes advantage of the physics of water to create more efficient motive propulsion.

The present invention uses a far more efficient method of motive propulsion than previous human-powered boats, and takes advantage of the Venturi effect, to increase the amount of motive power that the boat has available. Furthermore, the current invention's flexible, ergonomic design makes it ideal for rehabilitative purposes.

SUMMARY OF THE INVENTION

This application claims priority to U.S. Provisional Application 61/959,693, filed on Aug. 30, 2013, with Uriel Arad as the inventor. U.S. Provisional Application 61/959,693 is hereby incorporated by reference in its entirety. The invention relates generally to the field of human-powered watercraft, and more specifically to the field of human-powered watercraft that utilize pedals to provide motive power. It is an objective of the present invention to create a human-powered watercraft, that uses elliptical pedal skis and/or handles attached to the elliptical pedal skis, can float on water when not moving, and is capable of varying speeds, depending on the desires of the user. A second objective is to create a human-powered watercraft that gives the user the full benefits of a cardiovascular full body low impact cross training workout. A third objective of the present invention is to provide a light human-powered watercraft that takes advantage of the Venturi effect, to create increased speed for the same amount of force exerted by the user. A fourth objective of the present invention is to create a human-powered watercraft that a human can power through using foot pedals. A fifth objective of the present invention is to create a human-powered watercraft that a human can power through hand pedals. A sixth objective of the present invention is to create a human-powered watercraft that can be used for purposes of physical rehabilitation. A seventh objective of the present invention is to create a human-powered watercraft that allows the user to move the craft and then stop it, and safely and comfortably view the surroundings while remaining on the craft. An eighth objective of the present invention is to create a human-powered watercraft that gyms and resorts can "rent out" to guests and members. The present invention contains several features which are not present in any watercraft of the prior art. These features enable fulfillment of the objectives of the invention.

It will be useful to discuss the pertinent prior art, and to discuss the differences between the present invention and the prior art.

INVENTIONS OF THE PRIOR ART

U.S. Pat. No. 6,595,813 by Lekhtman describes a water vehicle where a human presses down on pedals with his feet, and these pedals connect to large flippers which move in the water. This is different from the present invention, which contains a seat for greater stability, which is designed to utilize the Venturi effect to increase speed, and which contains pedals that rotate in a circular motion, making them more efficient than the pedals of the Lekhtman device. The method of operation of the pedals in the present invention is also different from those of the pedals of the Lekhtman device.

U.S. Pat. No. 8,043,134 by Krah describes a human-powered watercraft, shaped somewhat like a surfboard, which includes a board grasped by the user with his hands. The user pushes the board, which moves a fin beneath the watercraft to propel the craft from a sitting position to a moving position. The present invention includes several features that the invention of U.S. Pat. No. 8,043,134 does not include. Some of these features are that some embodiments of our invention have a seat for greater stability, and our invention is designed to utilize the Venturi effect to increase speed, and also contains pedals that rotate in a circular motion, making them more efficient than the flipper of the Krah device. The pedals propel a propeller in the present device, which is different from the single flipper below the device shown in Krah.

U.S. Pat. No. 7,607,959 by DeMint discloses a device similar to floating water skis that enables the user to "walk" on water using floating skis, which includes a propulsion device which "comprises a semibuoyant float including a surface configured to grip the water and submerge the float in response to a force applied to the float in a direction approximately opposite a direction of motion of the craft." This device, however, lacks the "Venturi Drive" of the present invention, which makes use of the Venturi effect to create additional force to propel the device. Demint's device also lacks the seat which is present in certain configurations of the present invention, and the hand-pedals and foot-pedals which are present in several configurations of the present invention. Our invention will also be more stable than that of Demint if the user chooses to stop the device and keep it stationary in the water.

U.S. Pat. No. 8,074,304 by Snyder describes an aquatherapy and recreation spa which includes the ability to include certain types of exercise equipment in the spa. However, an examination of Snyder's claims shows that Snyder's invention is a spa, not a vehicle, and is not designed to move. Therefore, it lacks any type of propulsion mechanism. The present invention includes the Venturi Drive, which can be powered by hand or foot pedals, or by stand-up paddling. These features are completely lacking in Snyder's invention. Furthermore, some configurations of the present invention include a seat for the user to sit in, while using the hand and foot pedals. These features are also lacking in Snyder.

U.S. Pat. No. 5,558,604 by Hopkins discloses an underwater treadmill device. This device is designed to allow the user to exercise underwater. However, an examination of Hopkins' claims shows that Hopkins' invention is not a vehicle, and therefore contains no propulsion system. The Venturi Drive, the ability to float, and the seat, for the user to sit in, which are all part of the present invention, are all lacking in Hopkins.

U.S. Pat. No. 6,290,626 by Vargas et. al. describes an underwater exercise apparatus. This contains a seat for the user to sit in, and also contains pedals. However, the pedals do not power anything similar to the Venturi Drive of the present invention. Vargas' device is simply meant to provide exercise to the user, and is not meant to move through or over the water. The present invention also contains both hand pedals and foot pedals in certain embodiments, and also contains floating members (2), designed to help the invention float stably on the water. These features are all lacking in Vargas' invention.

U.S. Pat. No. 5,123,641, by Abboudi, et. al. discloses an underwater treadmill. This device does not contain any means of propulsion, and also does not include a seat for the user to sit in, or floating members (2) designed to help the invention float on the water. Furthermore, Abboudi's device does not include hand pedals in any embodiment. These features are all parts of the present invention, though.

U.S. Pat. No. 6,490,989 by Ray describes a frame, and a large number of straps that can be attached to the frame. These straps can also be attached to a floatation device. This device does not disclose power through pedals in any embodiment, and does not appear to be human-powered. These features are all important parts of the present invention.

U.S. Pat. No. 8,408,954 by Sturm describes a device which is partially above the water line, and partially below the waterline, and describes the concept of foot contact pedals that can be used to aid in propulsion. The user is partially below the water and partially above the water. However, this device is very different from the present invention, where the user is completely above the water. Furthermore, the pedals of the present invention propel the invention in a different way from those of Sturm's device. In addition, Sturm's device includes nothing similar to the Venturi Drive of the present invention.

U.S. Pat. No. 5,090,928 by Rybczyck discloses a propulsion device for use with small boats and watercraft. This propulsion device does not use anything to the Venturi Drive, and also is not powered by either hand pedals or foot pedals. Therefore, the present invention includes components configured in a manner which is different from those of Rybczyck's invention, and also operates under principles different from those which Rybczyck's invention operates under.

U.S. Pat. No. 8,167,667 by Sturm also discloses a device where the user is partially above the water line, and partially below the waterline, and describes the concept of foot contact pedals that can be used to aid in propulsion. However, these foot pedals do not power anything similar to the Venturi Drive of the present invention, and the present invention provides stability and flexibility in a way that Sturm's invention does not. Furthermore, the present invention is designed for the user to be wholly above the waterline. Therefore, the present invention utilizes principles that are different from those utilized by Sturm's invention.

U.S. Pat. No. 5,860,378 by Schaller describes a small manually operated vessel. This vessel includes propellers, and a means for manually activating these propellers. However, the patent is not specific about the means for actuating the propellers. Several embodiments of the present invention are specifically shown to be powered by pedals, and to include a system of components for translating force exerted on the pedals into motive power for the device. Furthermore, the present invention includes a Venturi Drive that is supposed to increase the power provided by the pedals. Schaller does not include anything similar to the Venturi Drive.

U.S. Pat. No. 6,135,835 by Lekhtman discloses a human-powered water vehicle with pedals. Lekhtman's craft, however, does not include the Venturi Drive, or anything which operates along similar principles. The present invention includes these attributes. Furthermore, Lekhtman's device includes pedals below the waterline, and would not work with the pedals above the waterline, because the arrangement of the seat, the handle bars, and other components would need to be changed. The present invention includes pedals above the waterline, and those pedals can rotate in a way that exercises more of the user's muscles than the pedals in Lekhtman's device.

U.S. Pat. No. 5,868,649 by Erickson et. al. discusses a device which can be directed by a pool-user around the pool. Essentially, it is a long rod which the user can direct using his hand or foot. This is substantially different from the principles of operation of the present invention.

U.S. Pat. No. 7,371,138 by Spass discusses a boat with a pedal drive. This invention is substantially different from the present invention, however, because Spass simply discusses a "means of propulsion" for the method of powering the boat, while the present invention specifically utilizes a Venturi Drive coupled with human power to provide motive power in most embodiments, and a Venturi Drive coupled with human power and an engine to provide motive power in one embodiment. Our invention is also specific about the way that the Venturi Drive creates motive power for our watercraft. Spass's invention is also shaped substantially differently from the present invention, which means that the effect of the motive power provided by the "means of propulsion" in Spass's invention must be different from the effect upon our watercraft created by the motive power produced by the propulsion mechanisms in our invention. Spass's invention also operates using different principles from the present invention.

U.S. Pat. No. 5,163,857 by Hinsley describes a self-propelled boat, which is designed to be used in shallow water. This self-propelled boat includes a fin, which is controlled by the user to potentially provide motive power to the boat, when needed. This is very different from the present invention, which employs pedals, which power a "Venturi Drive", to provide motive power.

U.S. Pat. No. 4,172,427 by Kindred describes a water fin system that can be used to propel boats. The present invention operates on different principles from those of Kindred. For example, the present invention uses a Venturi Drive, powered by pedals, to power and move the watercraft of the present invention. U.S. Pat. No. 3,695,211 by Gross discloses a self-propelled boat, which includes a fin, which is powered by the feet of the boat occupant. This is very different from the present invention, which specifically uses pedals to power a Venturi Drive, which provides motive propulsion to the vehicle. The Venturi Drive also enhances the propulsion of our vehicle, which is an effect not seen or discussed in Gross's invention. U.S. Pat. No. 5,098,085 by Abboudi et. al. discloses an exercise apparatus for underwater use. This apparatus, however, is not designed for movement. Therefore, it includes no components which could facilitate movement. This is very different from the present invention, which is specifically designed for movement, and includes pedals and a Venturi Drive to facilitate movement.

U.S. Pat. No. 7,481,745 by Malazinksey discusses an underwater staircase that can be used for exercise. Malazinksey's invention was not designed for movement. This is very different from the present invention, which is a vehicle that moves. It also does not include the pedals, or Venturi Drive, of the present invention.

U.S. Pat. No. 3,084,356 by Wheat discloses a "pair of elongated, buoyant, water-walker members adapted for attachment to the respective feet of the user." This device does not include the pedal-driven propulsion system which is an essential feature of the present invention. Wheat's device also does not include anything similar to the Venturi Drive which is part of the present invention.

U.S. Pat. No. 5,433,680 by Knudsen describes an elliptical path pedaling system. This system is not designed to be used to travel across water, and therefore is very different from the device of the present invention. The device of the present invention includes components such as the Venturi Drive, and the floating members (2), which are lacking in Knudsen. Knudsen also would have no incentive to include these components, because Knudsen's device is not designed to operate on water.

U.S. Pat. No. 6,007,462 by Chen discloses an exercise device which is configured to be simple in construction. This device is not designed to be used on water, and therefore is fundamentally different from the present invention. Chen's device also includes nothing similar to the Venturi Drive, and Chen has no incentive to include a component similar to the Venturi Drive in his device, which is designed to be stationary.

Patent Application 2003/0024456 by Swetish describes a trolling motor for a boat. This, however, is a means of artificially powering a boat. It is fundamentally different from the present invention, which uses human power, and which is a complete vehicle. Furthermore, Swetish's invention does not include anything which performs the same function, or uses the same principles, as the Venturi Drive of the present invention.

The Aquaskipper is a human-powered hydrofoil. It is substantially different from the present invention, because the Aquaskipper is not designed to float on a body of water. Furthermore, the Aquaskipper must be kept moving continuously, or it will sink in the water. The present invention can float, stationary, on a body of water, with the user on board. The present invention also includes the Venturi Drive, which the Aquaskipper does not include.

The present invention is designed with recreational, rehabilitative, and transportation purposes in mind, and this combination of purposes is substantially different from the reasons that the inventions of the prior art were constructed. Therefore, though the inventions of the prior art may be well-suited for their purposes, the present invention is much more well-suited for its combination of purposes than any invention of the prior art. The present invention includes a combination of features not seen in the prior art, and utilizes these features in ways not contemplated by the prior art.

The preferred embodiment of the invention allows the user to exercise the biceps, dorsal muscles, quadriceps, calves, deltoids, lumbar muscles, gluteus maximus, hamstring muscles, and soleus muscles.

TERM NUMBERS

The following terms will be explained here. These definitions will be useful when interpreting the Summary of the Invention, and the Claims, and should provide additional clarity to those examining this patent application.

(2): Floating Member(s) which should provide buoyancy when the watercraft device is placed on the water. (3): Connecting Member(s), which connects the floating members together. (4): Junction Member(s) which rest on top of the floating members and touch the connecting members. (5): Gear Mount. (7): Pedal Gear(s). (8): Middle Beam(s), which connects the connecting members to each other. (9): Flexible drive shaft. (10): Seat(s) for the user(s) to sit in when using the device. (11): Foot Pedals. (12): Gear System. (13): Seat Connection Member. (14): Seat Strut. (20): Venturi Direction Plate. (21): Pipe Stabilization Pillar. (22): Venturi Pipe. (23): Pipe Stabilization Bolt. (24): Drive Direction Control. (25): Pipe Stabilization Fastener. (26): Drive Stabilization Strut. (28): Drive Direction Pillar. (29): Propeller. (31): Hand Pedals. (32): Holes in the seat. (33): Retractable Rudder. (35): Hand Pedal Mount. (37): Horizontal Handlebar Grip. (41): Cupholder (42): Fins. (43): Bell. (44): Cupholder Support Bar. (45): Platform support pivot peg. (46): Upper flexible coupling. (47): Lower flexible coupling. (48): Foot platform. (49): Vertical Handlebar grip. (50): Foot platform mount. (51): Secondary pivot peg. (52): Lower system connection member. (53): Coupling connector. (54): Steering support base. (55): Steering support pole. (56): Small plate. (57): Drive Stabilization links (59): Motor. (62): Secondary plate.

Other embodiments of the invention, which are described in this application, include gear mounts, pedal gears, seats, holes in the seats, foot pedals, hand pedals, seat connection members and seat struts, and hand pedal mounts.

The Venturi Drive

The Venturi effect is the reduction in fluid pressure that results when a fluid flows through a conflicted section of pipe. Some hydrofoil boat designs have been able to incorporate this principle into their construction, and have been able to achieve increased speed over conventional boats. However, so far, no human-powered watercraft has incorporated the use of the Venturi effect into its construction. The present invention does incorporate the use of the Venturi effect into its construction.

The present invention (watercraft) utilizes the Venturi effect by propelling water through a short pipe, called the Venturi pipe (22) located towards the rear of the watercraft. The Venturi pipe (22) has two circular openings, on both ends, and the opening closer to the front of the watercraft is larger than the opening towards the rear of the watercraft. The diameter of the Venturi pipe (22) decreases between the larger opening and the smaller opening. All of the embodiments of the watercraft discussed here also include two floating members (2), which are long, thin members that are lighter than water. All of the embodiments of the watercraft described herein include at least one connecting member (3) that connects the floating members (2), providing additional stability to the invention.

The "Venturi Drive" is another important collection of components, which forms part of the invention. The Venturi Drive of the preferred embodiment includes the propeller (29), the Venturi pipe (22), the drive direction control (24), the drive direction pillar (28), pipe stabilization pillar (21), the Venturi direction plate (20), the pipe stabilization bolt (23), the pipe stabilization fasteners (25), the drive stabilization struts (26), the drive stabilization links (57), and the small plate (56). The Venturi Drives of specific embodiments may include additional components.

The Venturi Drive is believed to have the unexpected effect of increasing the speed of the watercraft by a factor of at least 25%, for a given amount of exertion by the user, compared to the speed of the watercraft without the Venturi Drive.

Several embodiments of the invention will be described in this application, however, those skilled in the art will recognize that other embodiments are possible, without departing from the spirit of the invention, or from the combination of applications of different concepts here described.

The Preferred Embodiment

The preferred embodiment of the invention contains two floating members (2), two connecting members (3) that are perpendicular to the floating members (2), and fit partially in between the floating members (2) and partially into grooves in the floating members (2). The preferred embodiment also includes junction members (4) that secure the connecting members (3) to the floating members (2). This configuration creates buoyancy and stability, which is helpful to the user. The preferred embodiment also includes a middle beam (8), situated parallel to the floating members (2). The middle beam (8) connects the two connecting members (3) and is perpendicular to them.

On top of the middle beam (8) and in between the two connecting members (3) sits the steering mount base (54). The steering mount base (54) is fastened to the middle beam (8). The steering mount pole (55) projects up from the steering mount base (54). Along the steering mount pole (55) is the cupholder support bar (44) which contains cupholders (41). At the top of the steering mount pole (55) is the horizontal handlebar grip (37). One or more bells (43) are attached to the horizontal handlebar grip (37).

Also along the steering mount pole (55) and below the cupholder support bar (44) is a conjoining mechanism which connects the steering mount pole (55) to the two upper flexible couplings (47). The preferred embodiment of the invention enables the user to exercise several of his or her muscle groups by pressing on either the foot platforms (48) or the vertical handlebar grips (49). When the user presses on the foot platforms (48) this moves the foot platform mounts (50), which in turn connect via the platform pivot pegs (45) to the lower system connection member (52). The turning of the foot platform mounts (50), via the platform pivot pegs (45) causes the lower system connection members (52) to rotate, which turns the secondary pivot pegs (51). These then transmit motive power to the gear system (12). The gear system (12) then causes the flexible drive shaft (9) to move, because as the secondary pivot pegs (51) turn the gears within the gear system (12), this causes other gears within the gear system (12) to move the flexible drive shaft (9). Differential gear systems that will perform this task in a satisfactory manner are well-known. They include differential gear systems with an epicyclic train of gears designed to permit two or more shafts to rotate at different speeds. The gear system (12) causes the flexible drive shaft (9) to move, and the flexible drive shaft (9) connects to the propeller (29) and causes it to turn.

The user can also press, on the vertical handlebar grips (49) to move the vertical handlebar grips (49) in a rotation pattern. This pressure will transmit via the upper flexible coupling to the coupling connection member (53), which, will move, and, in turn, will cause the lower flexible coupling (47) to move, which, will cause the foot platform mounts (50) to move in the same direction. This will cause the propeller (29) to turn in the manner described above.

The operation of the Venturi Drive will now be further explained.

The Venturi pipe (22) has a greater diameter on the end closer to the steering mount pole (55) than on its other end. This is crucial to the Venturi pipe (22)'s exploitation of the Venturi effect, because it forces the water entering the Venturi pipe (22) through the wider end to exit through the narrower end, which increases the velocity of this water, and decreases its pressure.

The propeller (29) is inside the Venturi pipe (22). The propeller (29) turns and provides motive power for the craft. The Venturi direction plate (20) rests between the floating members (2). The drive direction pillar (28) projects through a hole in the Venturi direction plate (20), and through the Venturi pipe (22), and it terminates in the pipe stabilization bolt (23) which is at the lowest point of the Venturi pipe (22).

The drive direction control (24) is at the top of the drive direction pillar (28) and the user can change the direction in which the craft is propelled by turning the drive direction control (24). This will turn the drive direction pillar (28), which will then turn the Venturi pipe (22) and propeller (29).

The pipe stabilization pillar (21) is perpendicular to the drive direction pillar (28), and runs through the Venturi pipe (22). Pipe stabilization fasteners (25) are placed on each end of the pipe stabilization pillar (21).

The drive stabilization links (57) connect to the pipe stabilization fasteners (25) and to the small plate (56). The drive stabilization links (57) help connect the Venturi Drive stably to the rest of the craft. Drive stabilization struts (26) are bolted to the small plate (56) and to other components of the craft. This helps to secure the Venturi Drive to the rest of the craft.

Other embodiments of the invention include embodiments similar to the preferred embodiment, but which also include a retractable rudder (33). Another potential embodiment of the invention is similar to the preferred embodiment, but has a submerged motor (59) attached to the Venturi pipe (22) to provide additional power.

An additional embodiment includes fins (42) on the undersides of the backs of the floating members (2) as shown in the figures.

The preferred embodiment allows a user to practice stand-up paddling (SUP) through the water, and to use the hybrid elliptical structure of the watercraft to exercise various muscle groups.

Further Embodiments

The embodiments within another group of embodiments of the invention, which are driven by pedals, include the aforementioned Floating Members (2) and at least one Connecting Member (3). Embodiments within this group may also include junction members (4), gear mounts (5), pedal gears (7), and middle beam(s) (8), which connect the connecting members (3) to each other. Embodiments within this group may also include the following components: A flexible drive shaft (9), foot pedals (11), and a gear system (12), seat connection members (13), seat struts (14), Venturi direction plates (20), pipe stabilization pillars (21), Venturi pipes (22), pipe stabilization bolts (23), drive direction controls (24), pipe stabilization fasteners (25), drive stabilization struts (26), drive direction pillars (28), propellers (29), hand pedals (31), Holes in the seat (32), retractable rudders (33), hand pedal mounts (35), horizontal handlebar grips (37), cupholders (41), fins (42), bells (43), and cupholder support bars (44).

In one embodiment, the connecting member(s) (3) connect the floating members (2) together and provide increased stability for the device. The middle beams (8) connect to each of the connecting members (3), thus further increasing stability. The gear system (12) is mounted between the middle beams (8). The pedal gears (7) connect to the gear system (12) and the foot pedals (11) are on top of the pedal gears (7). The user pushes the foot pedals (11) with his or her feet, which causes the foot pedals (11) and pedal gears (7) to move. They, in turn, move the gear system (12), which causes the flexible drive shaft (9) to move.

The flexible drive shaft (9) then turns the propeller (29). The propeller (29) is inside the Venturi pipe (22).

The water going through the propeller (29) experiences the Venturi Effect, because of the constricting effect created by the Venturi pipe (22). The pressure created by the water goes down, and its density goes up. This increases the speed of the craft. The user can control the direction in which the Venturi drive is providing propulsion because the user can use his hands to use the drive direction control (24) to turn the drive direction pillar (28), which is attached to the drive direction control (24). The propeller (29) and Venturi pipe (22) then turn together with the drive direction control (24). The drive direction pillar (28) is secured to the bottom of the Venturi pipe (22) by the pipe stabilization bolt (23). The drive stabilization struts (26) keep the Venturi pipe (22) securely fastened to the device while the Venturi pipe (22) turns. The pipe stabilization pillar (21) also helps to ensure the stability of the Venturi pipe (22) and turn the Venturi pipe (22) when needed.

The user can move the horizontal handlebar grips (37) which partially encase the handles, and can use them to turn the craft.

The two floating members (2), are long, thin members that are lighter than water. There is also a connecting member (3) that connects the floating members, and provides additional stability to the invention. This embodiment of the invention also includes one or more seats (10) for the user to sit. The seat (10) is connected to the floating members (2) by seat connection members (13). The embodiment includes pedals. This embodiment of the invention includes foot pedals (11) which connect to the pedal gears (7), which then connect to the gear system (12). The foot pedals (11), pedal gears (7), and gear system (12) are mounted on the gear mount (5) close enough to the seat (10) that the user can use the pedals with his or her feet.

Another embodiment within this group utilizes hand pedals (31) which are mounted on the middle beam (8) close enough to the seat (10) that the user can use the pedals with his or her hands. The hand pedals (31) drive the gear system (12) which drives the flexible drive shaft (9) in this embodiment. Still another embodiment uses both foot pedals (11) and hand pedals (31), which are mounted on the middle beam (8). In all embodiments described in this section, the foot pedals (11) and/or hand pedals (31) drive a gear system (12) which drives a flexible drive shaft (9), which turns a propeller (29) which is inside the Venturi pipe (22). The Venturi pipe (22) is constricted, and therefore the water flowing through the Venturi pipe (22) experiences a drop in pressure. This means that the watercraft can accelerate more, using the same amount of force applied by the user, than another watercraft which does not utilize the Venturi effect.

In the embodiment using foot pedals (11), the user(s) sit in the seats (10), and so can use the foot pedals (11) to power the watercraft while having his or her hands free.

Tests of craft embodying this basic principle, in natural bodies of water, indicate that craft embodying this principle have been successful at creating an increased amount of propulsion with the same amount of force, and have represented a successful application of the Venturi effect.

The seat (10) may also include holes (32) to allow water to drain more easily from the seat, and may also be made of waterproof material.

Those skilled in the art will recognize that other embodiments of the invention are possible without detracting from the basic principles of the invention.

The floating members (2) should be lighter than water, because the floating members (2) provide buoyancy and stability which is essential to the usefulness of the invention. One possible method of constructing the floating members (2) is by making them urethane coated, and internally reinforcing them with aluminum rods. Many of the other parts, specifically the gear system (12) should be constructed out of aluminum or other lightweight, but strong, materials.

Manufacturers of vehicles, including human-powered watercraft, are continually looking for new ways to make their vehicles move faster. This indicates a long-felt need for a feature such as the Venturi Drive, in the field of human-powered watercraft. In addition, this need is "unsolved" in the sense that new design improvements that make watercraft faster are generally desired by those active in the art of making human-powered watercraft. Therefore, as those active in the art will recognize, there is a long-felt need for the device explained here.

The Process

This is the first human-powered watercraft making practical use of the process of using human power to provide motive power to a combination of components specifically designed to take advantage of the Venturi effect. The process has many benefits, including exercising the muscle groups discussed above. The process of using human power to provide motive power to a watercraft propelled through a combination of components specifically designed to take advantage of the Venturi effect is an additional invention in itself, which is linked to the watercraft discussed here.

DETAILED DESCRIPTION OF THE DRAWINGS

Figure 1:
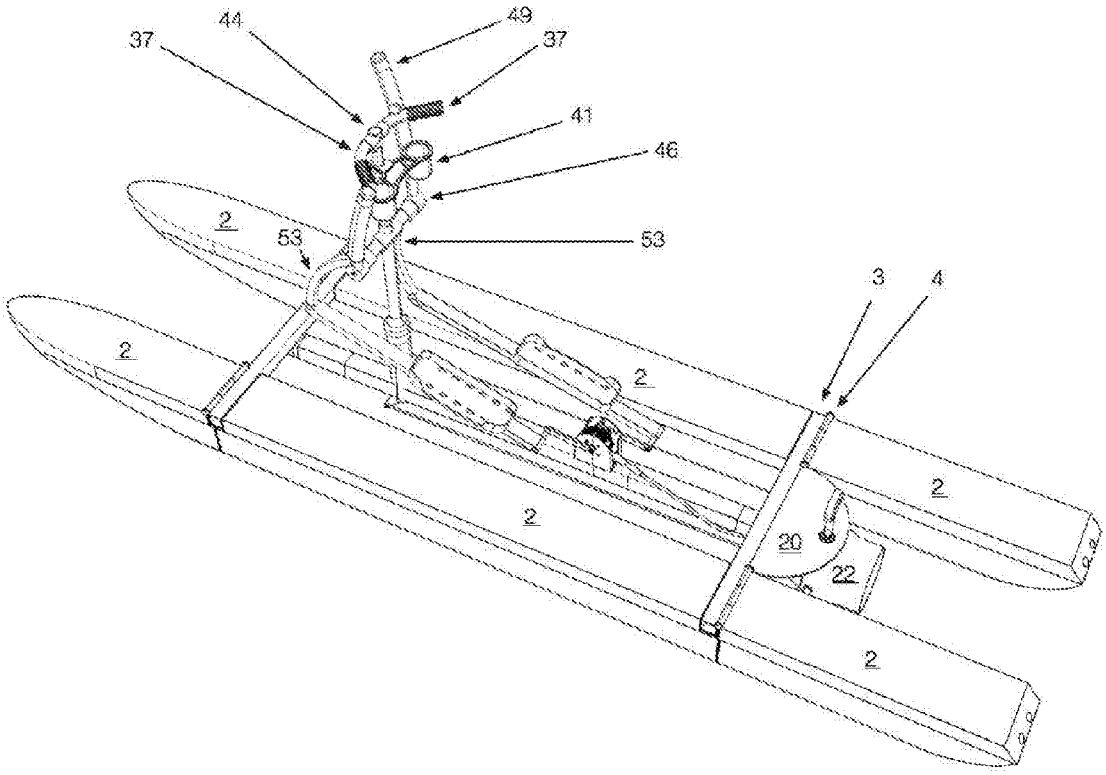
FIG. 1 shows the preferred embodiment of the invention from a "bird's-eye" perspective.

FIG. 1 shows the preferred embodiment of the invention from the "bird's-eye" perspective of a viewer looking to the right at the embodiment. The floating members (2) are designated. The user can see that the floating members (2) have different segments, but each floating member (2) is one component. One of the connecting members (3) is designated, and the junction member (4) shown next to the connecting member (3) is also designated. The Venturi direction plate (20) can be seen, between the floating members (2) and next to one of the connecting members (3) and the Venturi pipe (22) can be seen below the Venturi direction plate (20). Both of the coupling connectors (53) are designated. One of the upper flexible couplings (46) is designated. Both upper flexible couplings (46) connect to the coupling connectors (53) and to the vertical handlebar grips (49). One of the two cupholders (41) in this embodiment is also designated, and both are shown. The horizontal handlebar grip (37) is also shown, and the bell (44) is shown on top of the horizontal handlebar grip (37).

Figure 2:
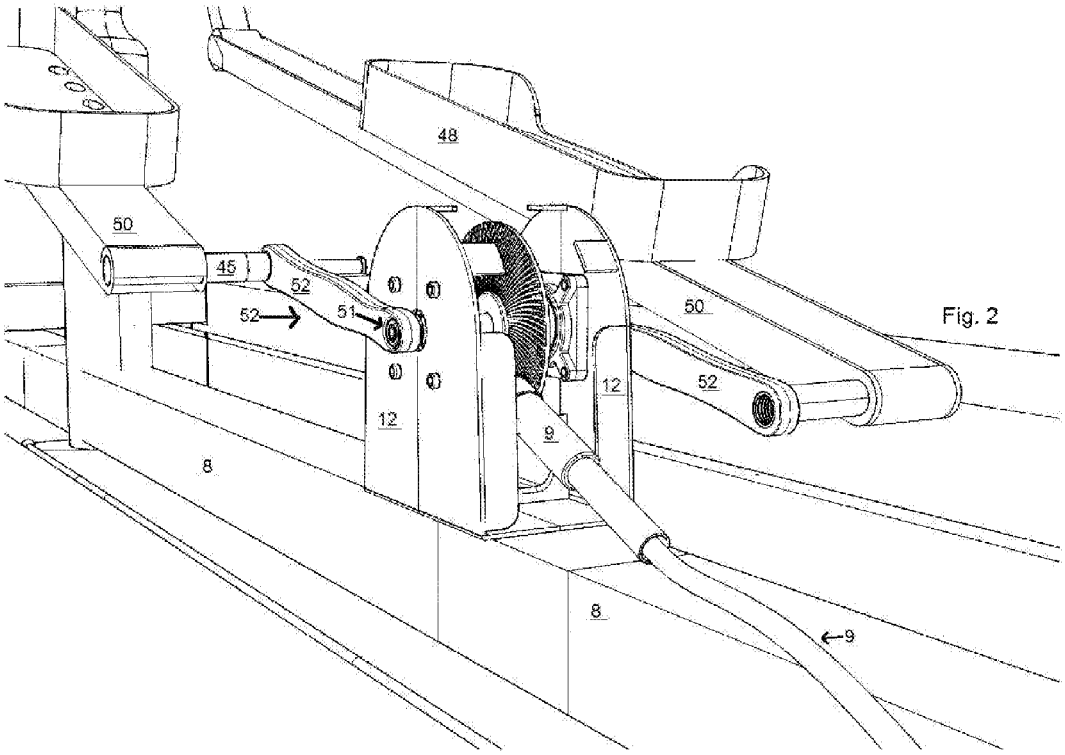
FIG. 2 shows a close-up view of several components of the invention, which are situated towards the front of the preferred embodiment.

FIG. 2 shows the gear system (12) and the flexible shaft (9) leading from it. In addition, the lower system connection members (52) can be seen connected to the gear system by the secondary pivot pegs. One of the secondary pivot pegs (51) is designated. The lower system connection members (52) are each also connected to a foot platform mount (50) via a platform support pivot peg (45). One of the platform support pivot pegs (45) is designated. This figure is a "close-up" view of the gear system and nearby components.

Figure 3:
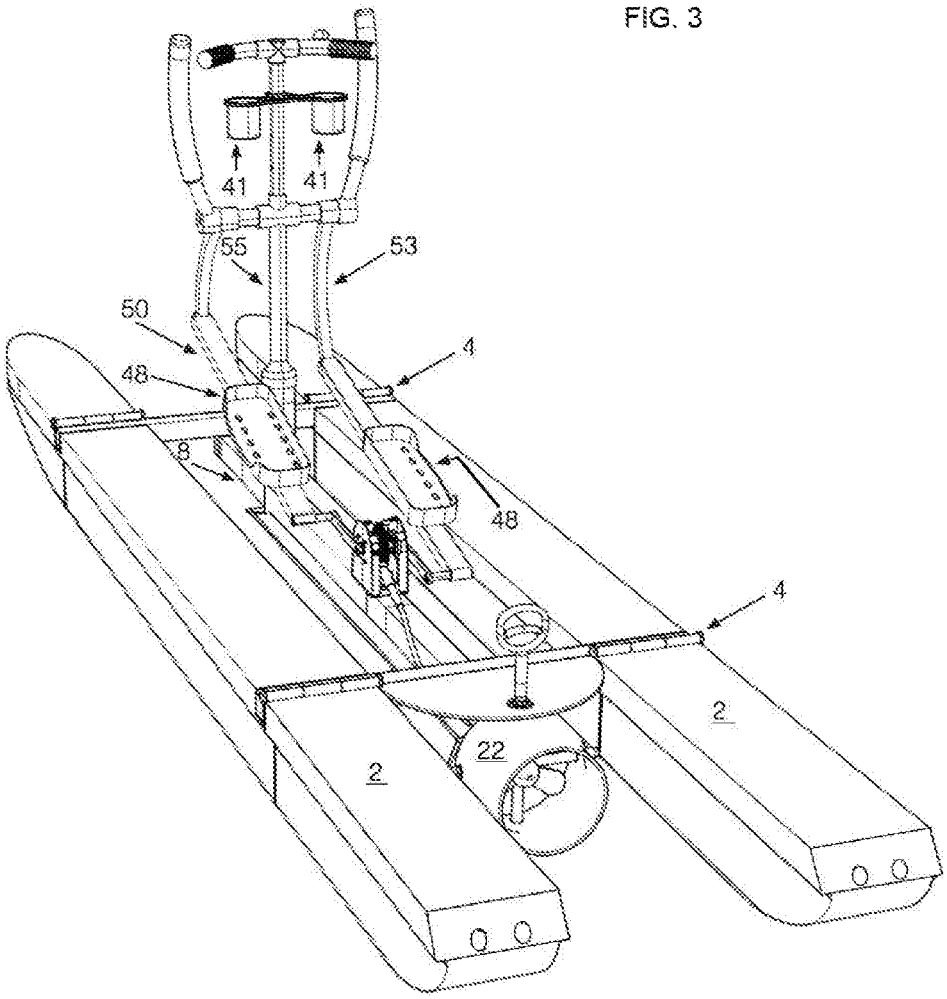
FIG. 3 shows a "bird's-eye" view of the preferred embodiment of the invention from the perspective of an observer who is to the back of, and above, the embodiment.

FIG. 3 shows a "bird's-eye" view of the preferred embodiment of the invention from the perspective of an observer who is to the back of, and above, the embodiment. The floating members (2) can be seen, and the Venturi direction pipe (22) is clearly visible. Two of the junction members (4) are also designated on the right side of the craft. The middle beam (8) is clearly visible between the floating members (2). Both of the foot platforms (48) are designated, and one of the foot platform mounts (50) is also designated, which shows how a user can move the foot platform mounts (50) by moving the foot platforms (48). The steering support pole (55) is also shown and designated, and one of the two coupling connectors (53) is also designated. Both of the cupholders (41) in this embodiment are also designated.

Figure 4:
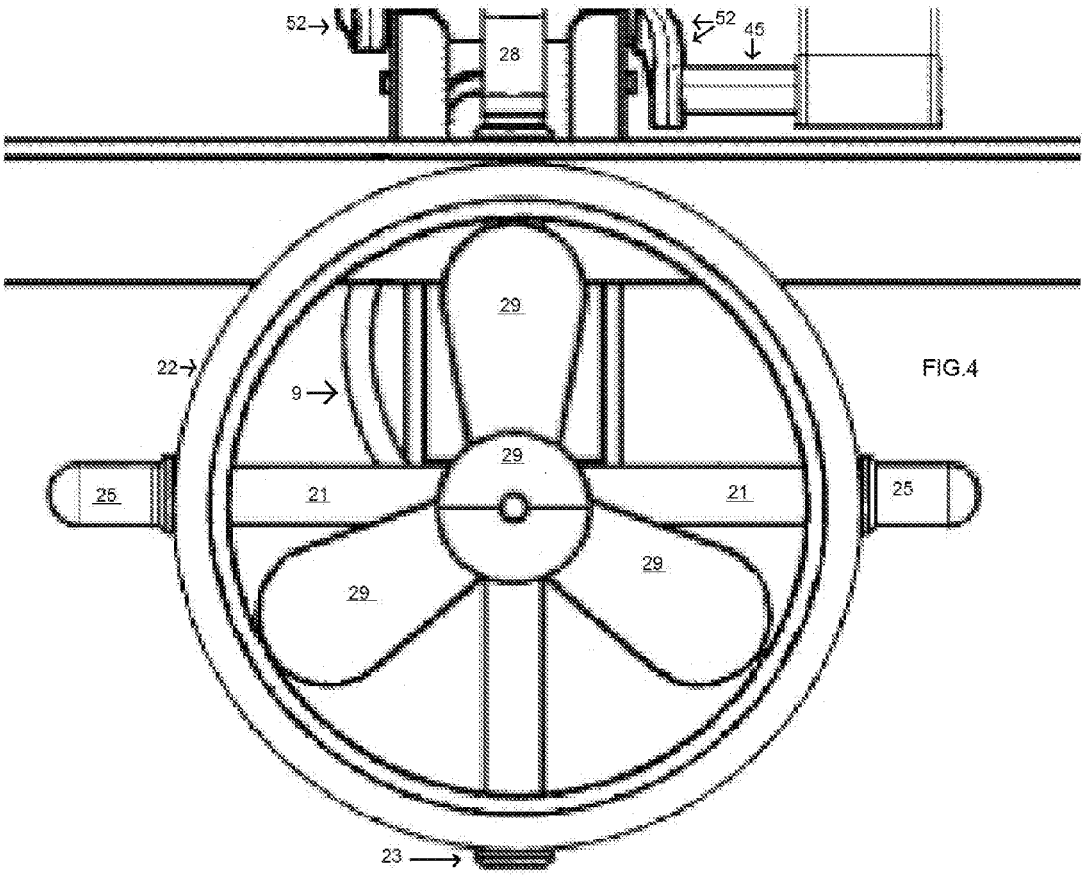
FIG. 4 shows a close-up view of several components of the invention, which are situated towards the back of the preferred embodiment.

FIG. 4 shows several of the "Venturi Drive" components "close-up", in a magnified view, so that the user can get a better idea of how these components fit together. The propeller (29) is shown inside the Venturi pipe (22) and the flexible drive shaft (9) is shown leading to the propeller (29). The pipe stabilization pillar (21) can be seen positioned horizontally through the Venturi pipe (22). One pipe stabilization fastener (25) is on each end of the pipe stabilization pillar (21). The ends of the pipe stabilization pillar (21) protrude through holes in the Venturi pipe (22) and terminate in the pipe stabilization fasteners (25). The drive direction pillar (28) can be seen positioned vertically through the Venturi pipe (22), and the drive direction pillar (28) terminates in the Pipe stabilization bolt (23), which is on the underside of the Venturi pipe (22).

Figure 5:
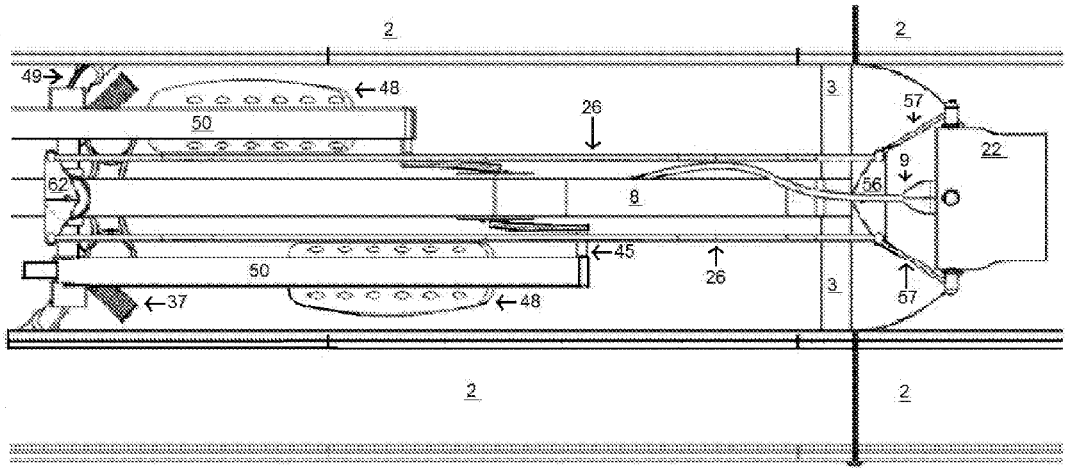
FIG. 5 shows a close-up view of different components that are on the bottom of the preferred embodiment.

FIG. 5 shows the "Venturi pipe (22)" and several components that connect the Venturi pipe (22) to the rest of the watercraft of the preferred embodiment. The small plate (56) and the secondary plate (62) can be seen. In addition, the pipe stabilization links (57) link the Venturi pipe (22) to the small plate (56). This provides greater structural stability to the watercraft. The middle beam (8) can also be seen. Furthermore, both of the foot platform mounts (50) are designated, and the flexible drive shaft (9) can be seen extending below the middle beam (8).

Figure 6:
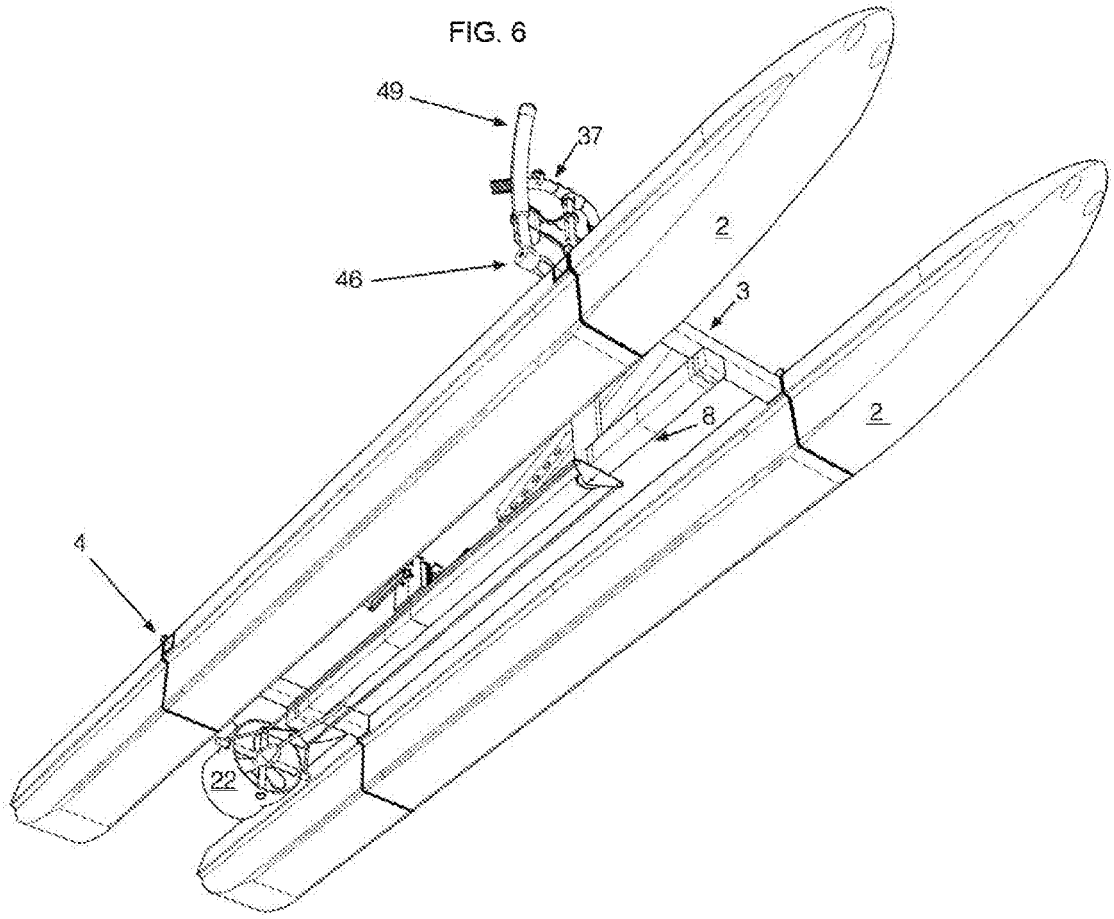
FIG. 6 shows a "bird's-eye" view of the preferred embodiment of the invention from the perspective of an observer who is below and to the right of the embodiment.

FIG. 6 shows a "bird's-eye" view of the preferred embodiment of the invention from the perspective of an observer who is below and to the right of the embodiment. The Venturi pipe (22) is shown towards the back of the invention. The floating members (2), middle beam (8), and connecting members (3) are all visible, and one of the connecting members (3) is designated. Above the floating members (2), a vertical handlebar grip (49), a horizontal handlebar grip (37), and an upper flexible coupling (46) are all visible and designated.

Figure 7:
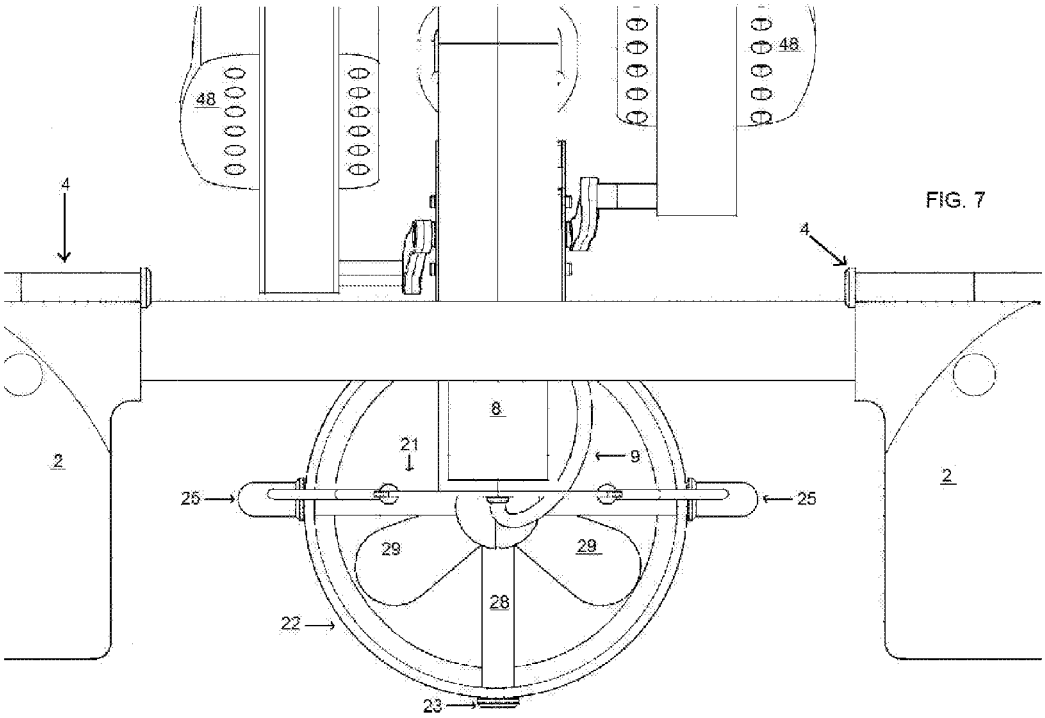
FIG. 7 shows a "close-up" of some of the components comprising the Venturi Drive of the preferred embodiment, from the viewpoint of an observer who is situated below the invention and in front of the Venturi pipe (22).

FIG. 7 shows a "close-up", magnified view of some of the components comprising the Venturi Drive of the preferred embodiment, from the viewpoint of an observer who is situated below the invention and in front of the Venturi pipe (22). The connection of the flexible drive shaft (9) to the propeller (29) can be clearly seen, and the middle beam (8) can also be partially seen. The Venturi pipe (22) is shown, and the propeller (29) is clearly visible within the Venturi pipe (22). The drive direction pillar (28) is shown going through the propeller (29) and terminating below the propeller (29). The pipe stabilization bolt (23) is visible on the bottom of the drive direction pillar (28). The drive direction control (24) is also partially visible on the top of the drive direction pillar (28). A user can turn the drive direction control (24) to turn the drive direction pillar (28). The pipe stabilization pillar (21) can be seen projecting horizontally through the Venturi pipe (22) and the pipe stabilization pillar (21) is perpendicular to the drive direction pillar (28). The pipe stabilization fasteners (25) are on both sides of the pipe stabilization pillar (21).

Figure 8:
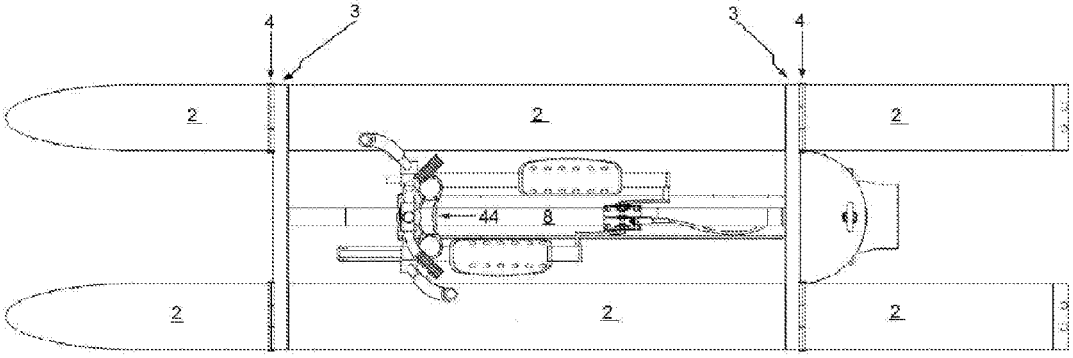
FIG. 8 shows a view of the preferred embodiment from directly above.

FIG. 8 shows the preferred embodiment from directly above. Both of the floating members (2) are clearly shown, and the user can tell the location of the junction members (4) and connecting members (3). The cupholder support bar (44) is also designated.

Figure 9:
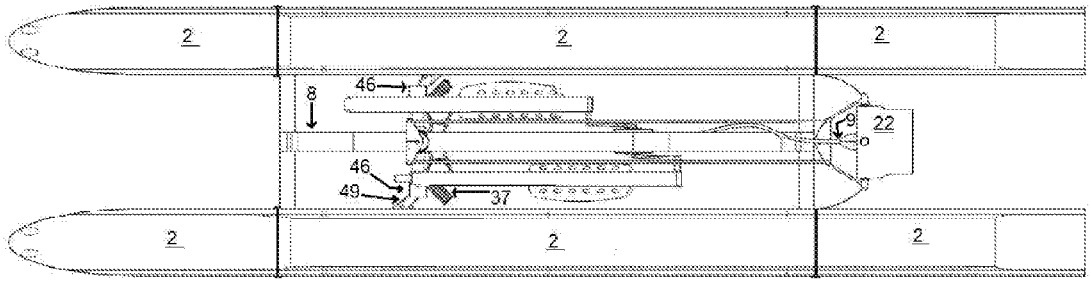
FIG. 9 shows a view of the preferred embodiment from directly below.

FIG. 9 shows the preferred embodiment from directly below. Both of the floating members (2) are clearly visible and designated. The flexible drive shaft (9) can also be seen between the floating members (2). The Venturi pipe (22) is also clearly visible. The middle beam (8) can be seen between the floating members (2). (4) Designates one of the junction members, part of which can be seen. The upper flexible coupling (46), the vertical handlebar grips (49) and the horizontal handlebar grips (37) can be seen above the floating members (2). The viewer can also see the foot platforms (48).

Figure 10:
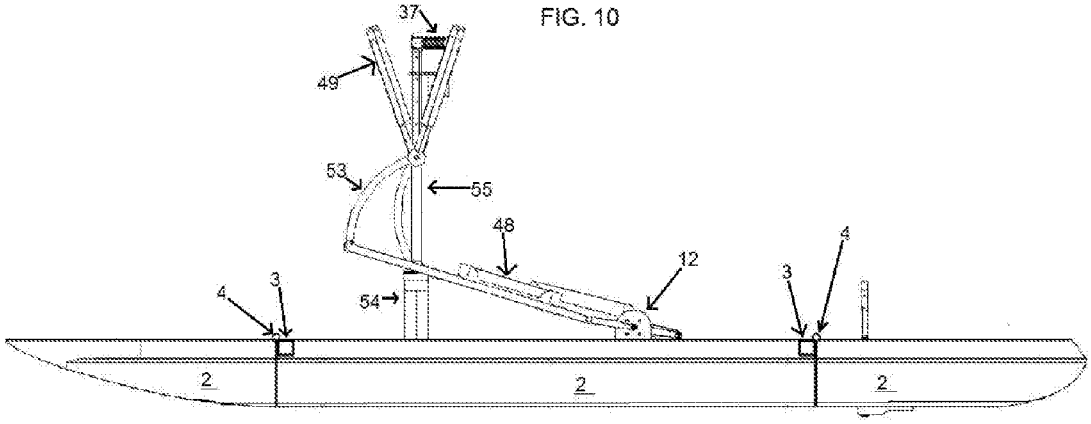
FIG. 10 shows a view of the preferred embodiment from the perspective of an observer who is directly to the left of the embodiment.

FIG. 10 shows the preferred embodiment from the left. One of the floating members (2) can be seen. The connecting members (3) can also be seen, as well as the fact that they are partly inlaid within the floating members (2). Furthermore, two of the junction members (4) can be seen on top of one of the floating members (2). Above the floating member (2), the gear system (12) can also be seen, and the steering support base (54) also protrudes upwards, supporting the steering support pole (55). Both of the coupling connectors (53) can be seen.

Figure 11:
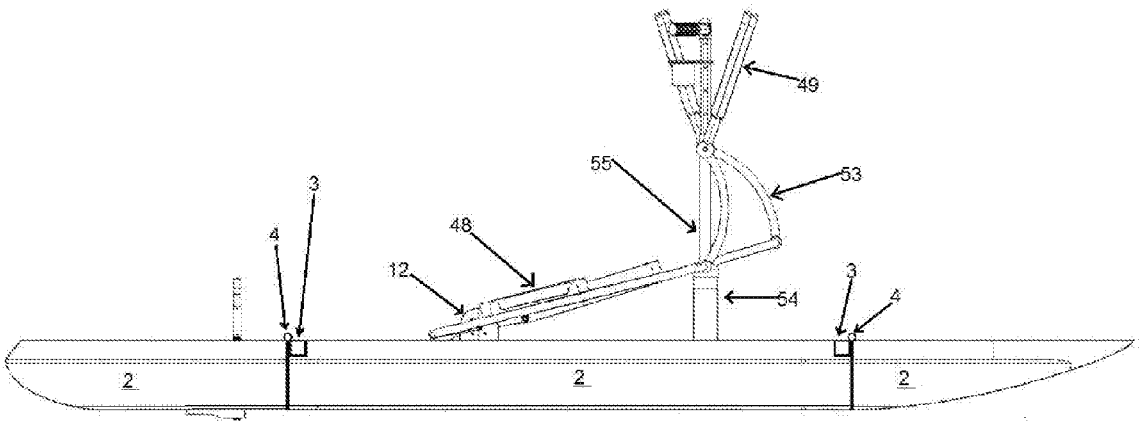
FIG. 11 shows a view of the preferred embodiment from the perspective of an observer who is directly to the right of the embodiment.

FIG. 11 shows the preferred embodiment from the right. One of the floating members (2) can be seen. The connecting members (3) can also be seen, as well as the fact that they are partly inlaid within the floating members (2). Furthermore, two of the junction members (4) can be seen on top of one of the floating members (2). Above the floating member (2), the gear system (12) can also be seen, and the steering support base (54) also protrudes upwards, supporting the steering support pole (55). Both of the coupling connectors (53) can be seen. The vertical handlebar grips (49) are clearly visible. The foot platforms (48) can also be seen, though they overlap.

Figure 12:
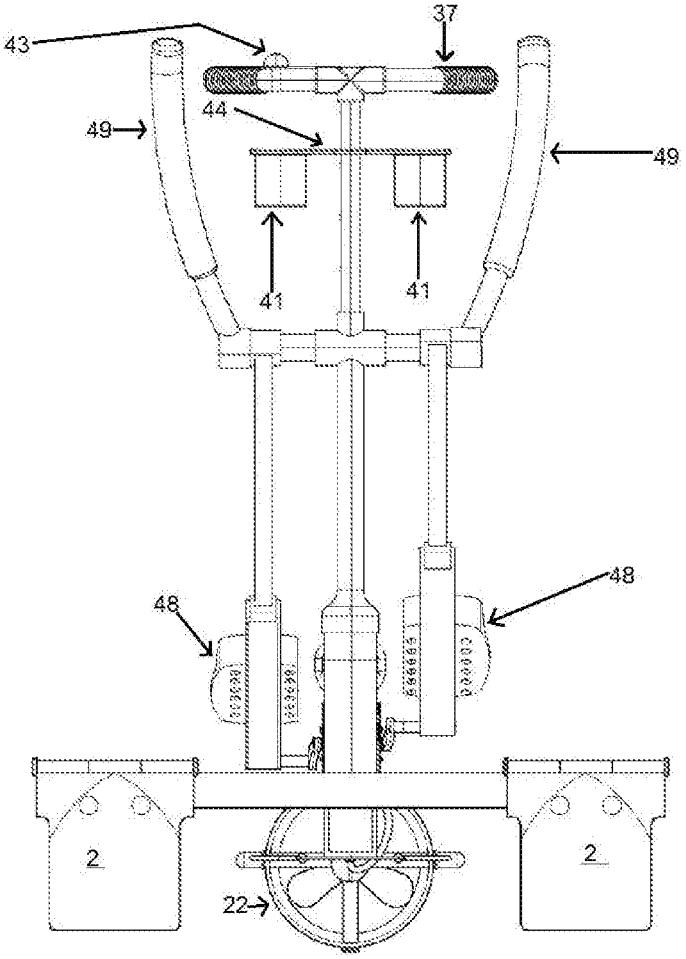
FIG. 12 shows the preferred embodiment from the front.

FIG. 12 shows the preferred embodiment from the front. Both of the floating members (2) can be seen, and the manner in which they support many of the other parts of the device can also be discerned. The middle beam (8) can be seen in between them. It supports other components. The vertical handlebar grips (49) are also visible at the top of the device. Some of the components to the rear of the device, such as the Venturi pipe, can also be seen.

Figure 13:
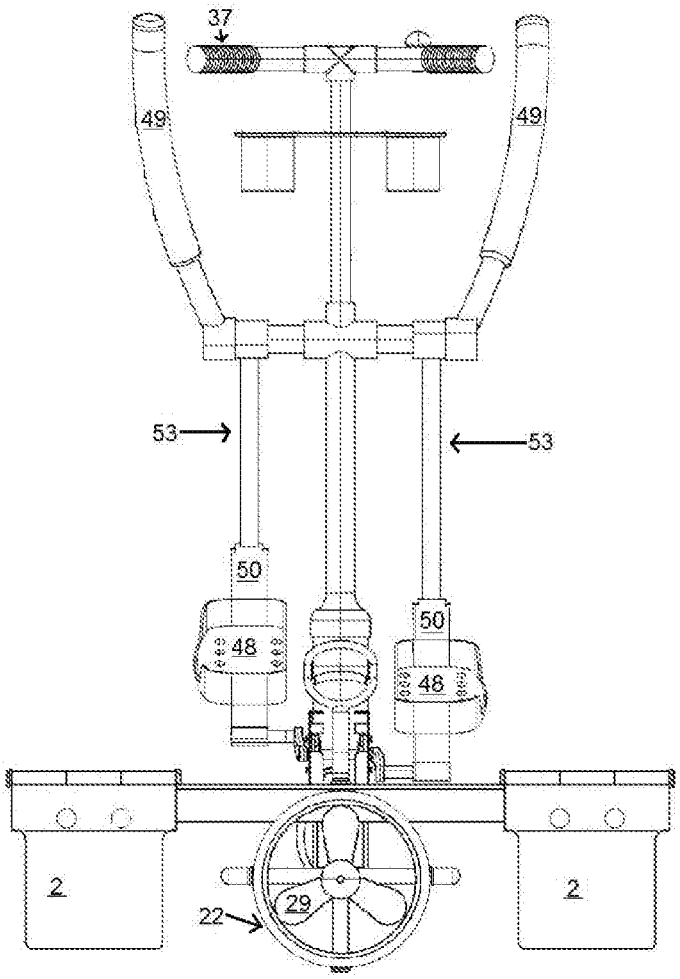
FIG. 13 shows the preferred embodiment from the back.

FIG. 13 shows the preferred embodiment from directly behind. The Venturi pipe (22) can clearly be seen here, along with several components connected to it. The vertical handlebar grips (49) can also be seen at the top of the device. In addition, both of the floating members (2) are visible, and the way in which they support numerous other components can also be determined. The propeller (29) can also be seen.

Figure 14:
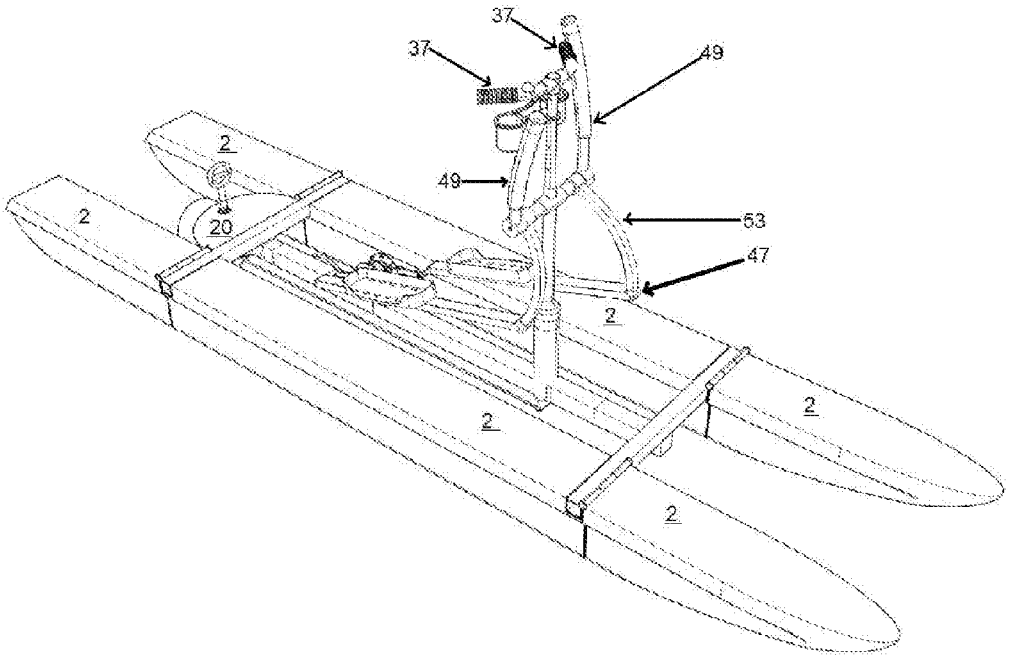
FIG. 14 is another view of the preferred embodiment, from the perspective of an observer who is above and to the right of the embodiment.

FIG. 14 shows the preferred embodiment from a "bird's-eye" view of a viewer who is to the right, and above, the embodiment. Both of the floating members (2) can be seen supporting many of the other components of the device. Furthermore, the connecting members (3) can be seen, and they connect the floating members (2) together. The vertical handlebar grips (49) and horizontal handlebar grips (37) can be seen at the top of the device. Both of the coupling connectors (53) can be seen, and one of them has been designated. The Venturi direction plate (20) is designated, in the back of the device.

Figure 15:
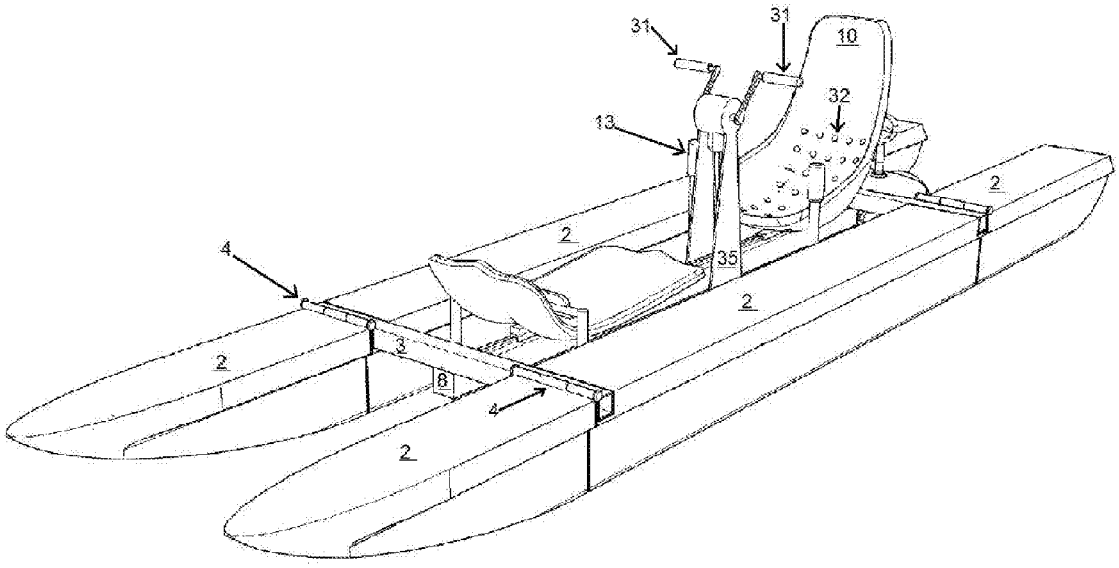
FIG. 15 shows a side view of another embodiment of the invention, which is hand-powered. The embodiment is shown from a "bird's-eye" perspective of a viewer who is to the left of the embodiment.

FIG. 15 shows a side view of another embodiment of the invention, which is hand-powered. The embodiment is shown from a "bird's-eye" perspective of a viewer who is to the left of the embodiment. The hand pedal mount (35) is clearly visible, as are the hand pedals (31). The gear system is connected to the hand pedals (31) and atop the hand pedal mount (35). The seat (10) is also clearly visible, and one of the seat connection members (13) is designated. In addition, both of the connecting members (3) are partly visible, and one of them is designated. Three of the junction members (4) are visible, and two of them are designated.

Figure 16:
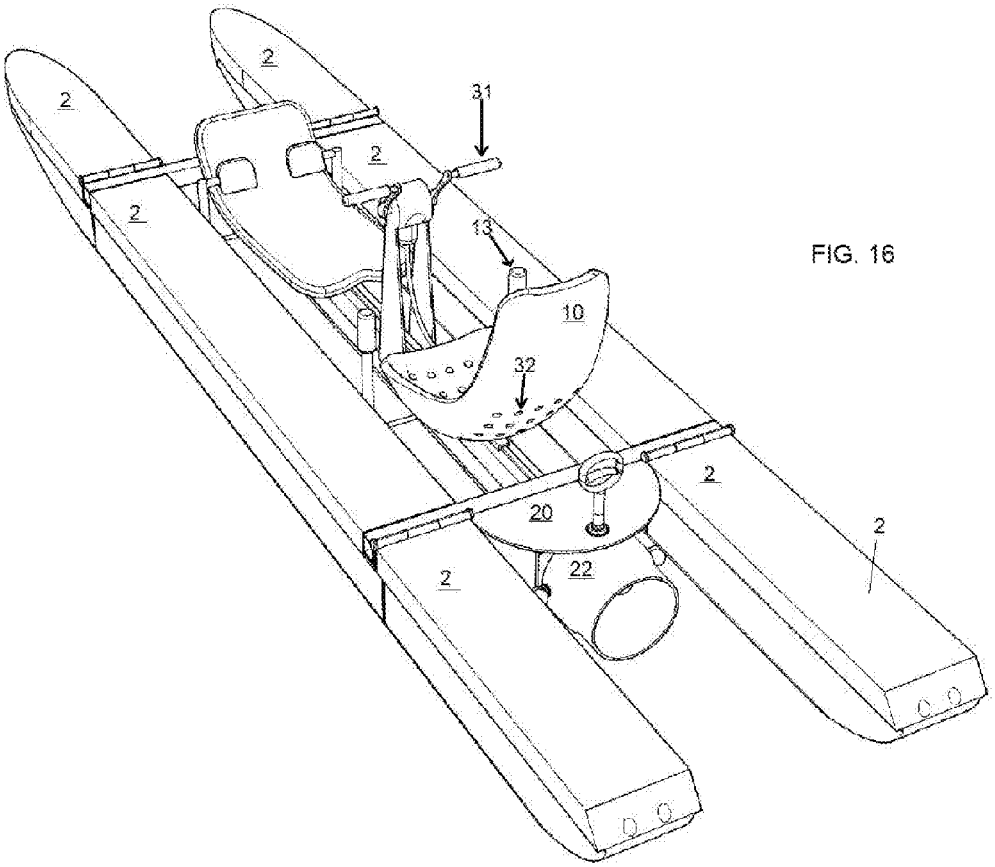
FIG. 16 shows the hand-powered embodiment of the invention from the perspective of an observer who is to the back of the invention, and looking down at the embodiment.

FIG. 16 shows the hand-powered embodiment of the invention from the perspective of an observer who is to the back of the invention, and looking down at the embodiment. One of the hand pedals (31) is designated. Both of the seat connection members (13) can be partially seen, and one of them is designated. The seat (10), and its holes, are also seen, and one of the holes in the seat (32) is designated. The Venturi pipe (22) is visible towards the back of the craft. The Venturi direction plate (20) is also designated.

Figure 17:
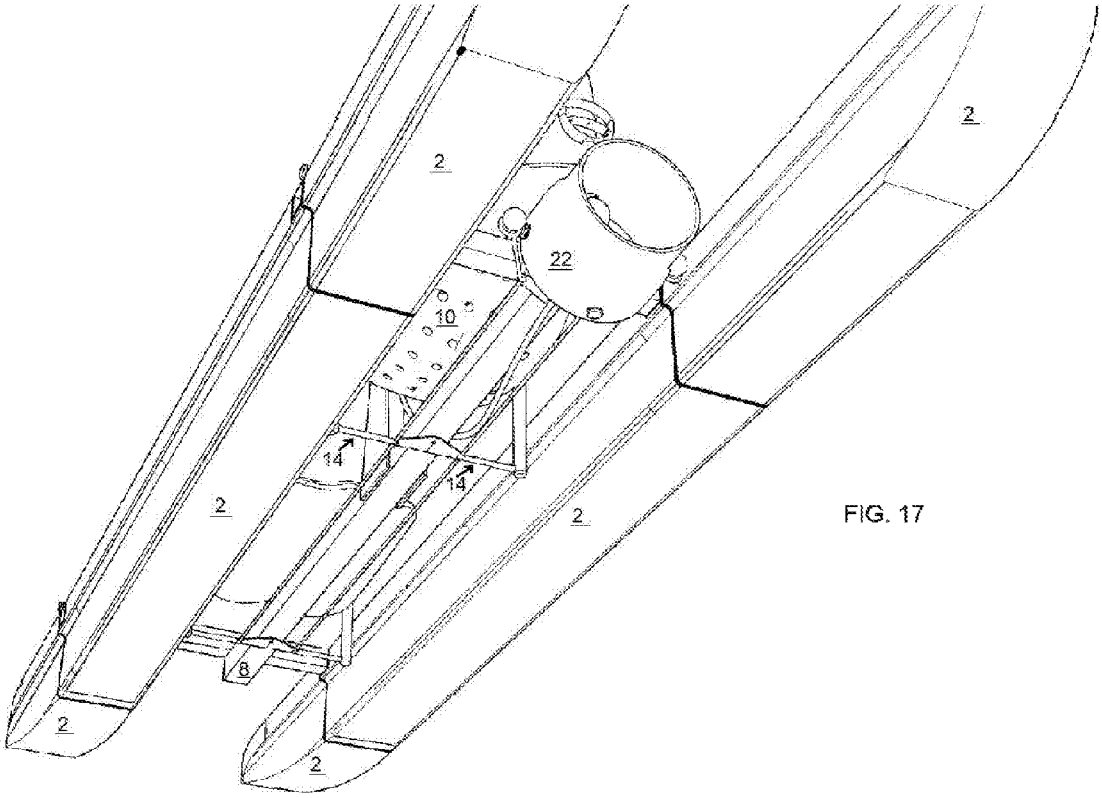
FIG. 17 shows a view of the hand-powered embodiment from the perspective of a viewer who is below, and to the front of, the embodiment.

FIG. 17 shows a partial view of the hand-powered embodiment from the perspective of a viewer who is below, and to the front of, the embodiment. Here the seat struts (14) can be seen, connected to the seat connection members. The underside of the seat (10) is also visible. Both of the floating members (2), are clearly visible, and the Venturi pipe (22) is visible towards the back of the craft.

Figure 18:
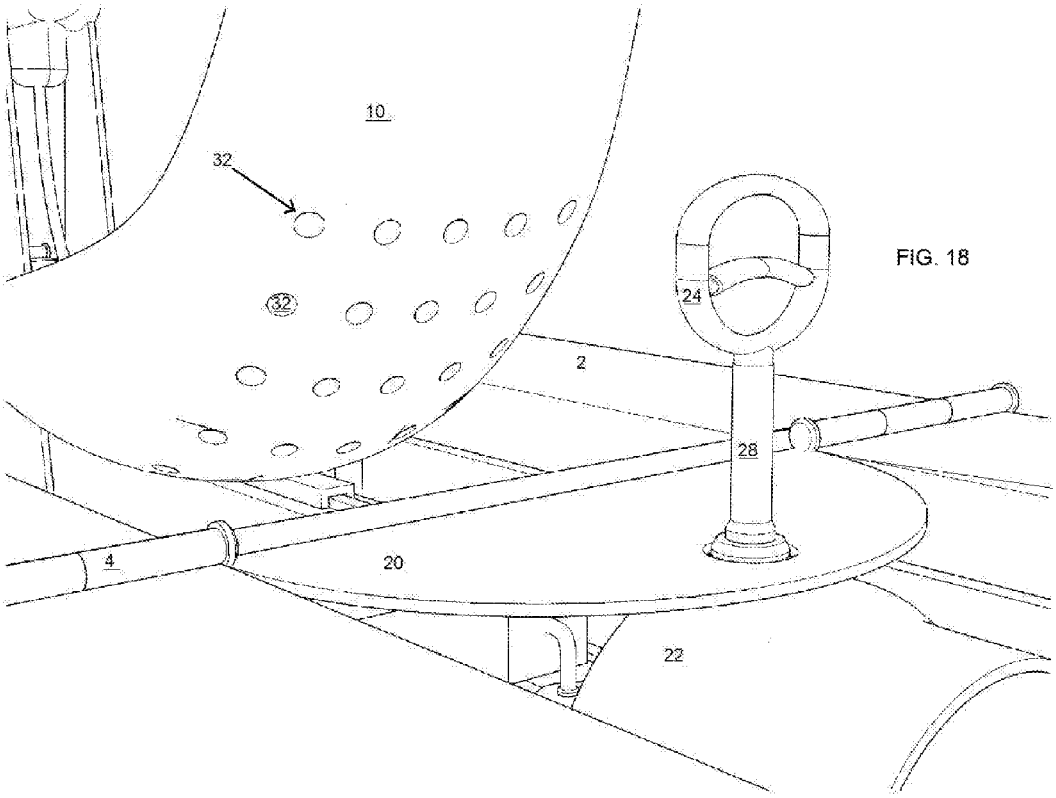
FIG. 18 shows a "close-up" view of some of the components of the Venturi Drive of the hand-powered embodiment.

FIG. 18 shows a "close-up", magnified view of some of the components of the Venturi Drive of the hand-powered embodiment. The seat (10) is visible, as are holes in the seat (32). Furthermore, the Venturi pipe (22) and, above it, the Venturi direction plate (20) can be seen clearly. Above, the drive direction pillar and drive direction control (24) can be seen extending upward from the Venturi direction plate (20). In addition, the viewer can see at least one of the junction members (4), which is designated. The user can also see part of both floating members (2).

Figure 19:
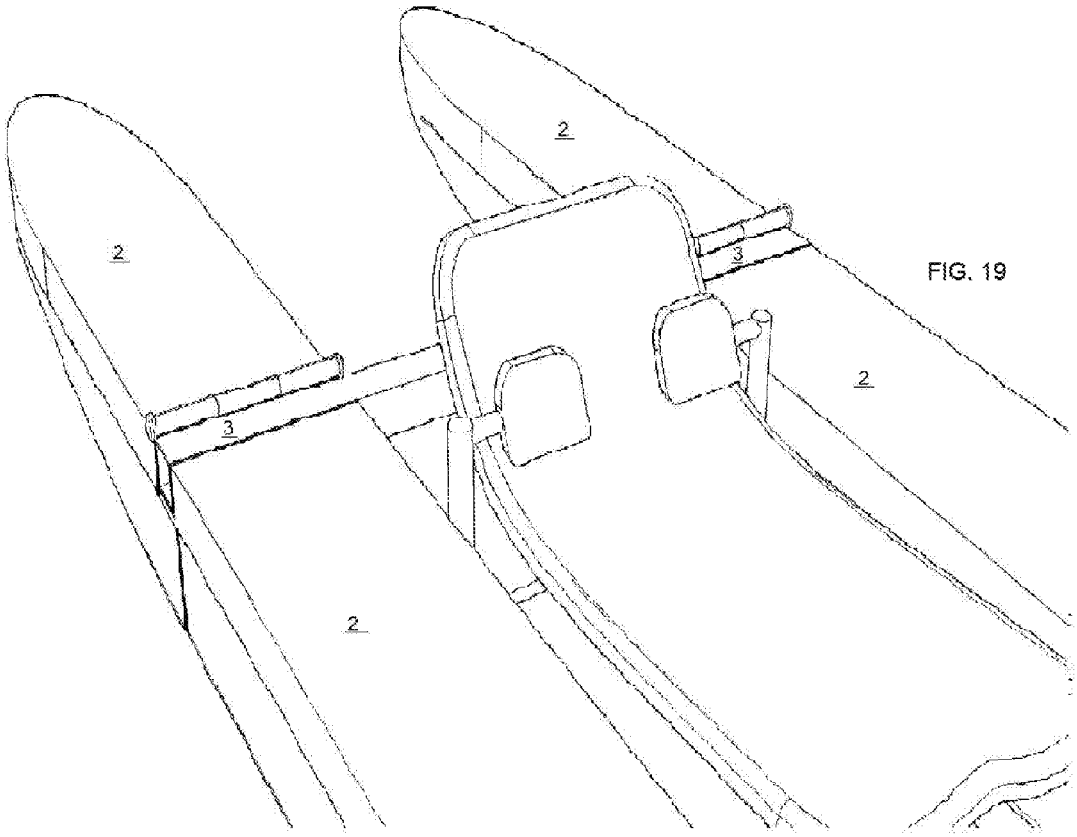
FIG. 19 shows a "close-up" view of part of the hand-powered embodiment of the present invention.

FIG. 19 shows a "close-up", magnified view of part of the hand-powered embodiment of the present invention. Parts of the floating members (2) can also be seen. In addition, the viewer can see one of the connecting members (3).

Figure 20:
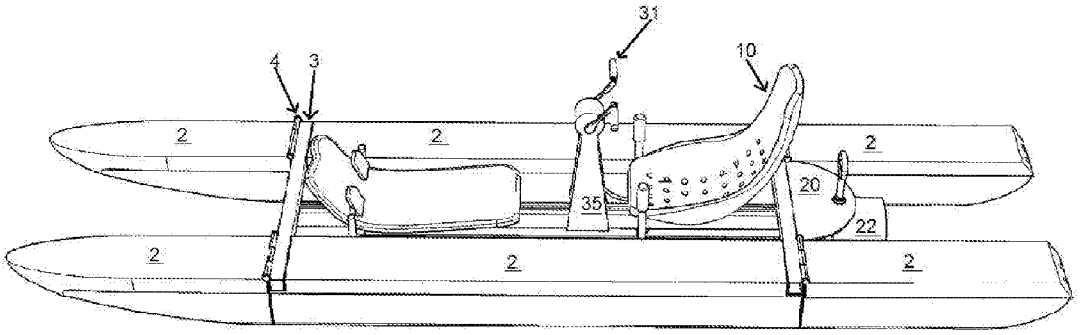
FIG. 20 shows a view of the hand-powered embodiment from the perspective of a viewer who is above, and to the left of, the embodiment.

FIG. 20 shows a view of the hand-powered embodiment from the perspective of a viewer who is above, and to the left of, the embodiment. The floating members (2) are both designated. The Venturi direction plate (20) is also visible in the back. Both of the connecting members (3) are also designated. The hand pedals (31) can be seen, and one of them is designated. The gear system is connected to the hand pedals (31) and atop the hand pedal mount (35).

Figure 21:
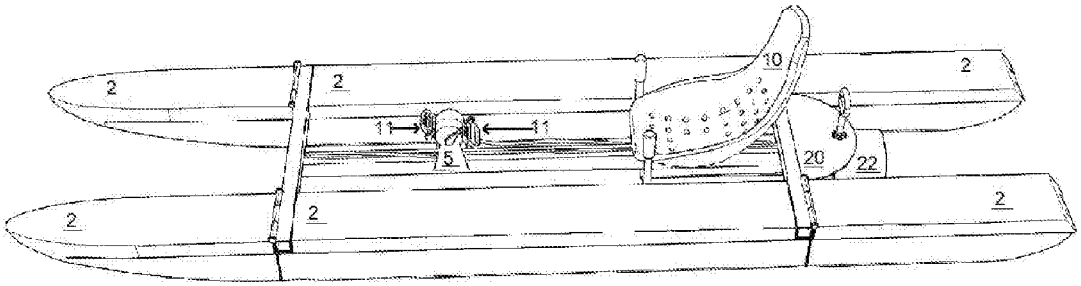
FIG. 21 shows a "bird's-eye" view of the foot-pedal powered embodiment of the invention, from the perspective of a viewer who is above, and to the left of, the embodiment.

FIG. 21 shows a view of the foot-pedal powered embodiment of the invention, from the perspective of a viewer who is above, and to the left of, the embodiment. Here the viewer can see the gear mount (5), and the pedal gears (7). One of the pedal gears (7) is designated. The flexible drive shaft (9) can also be seen coming out of the gear system. Both of the floating members (2) are clearly visible. The seat (10) is also visible. The foot pedals (11) can also be seen, and one of them is designated. The gear mount (5) can also be seen. The gear system is atop and inside the gear mount (5).

Figure 22:
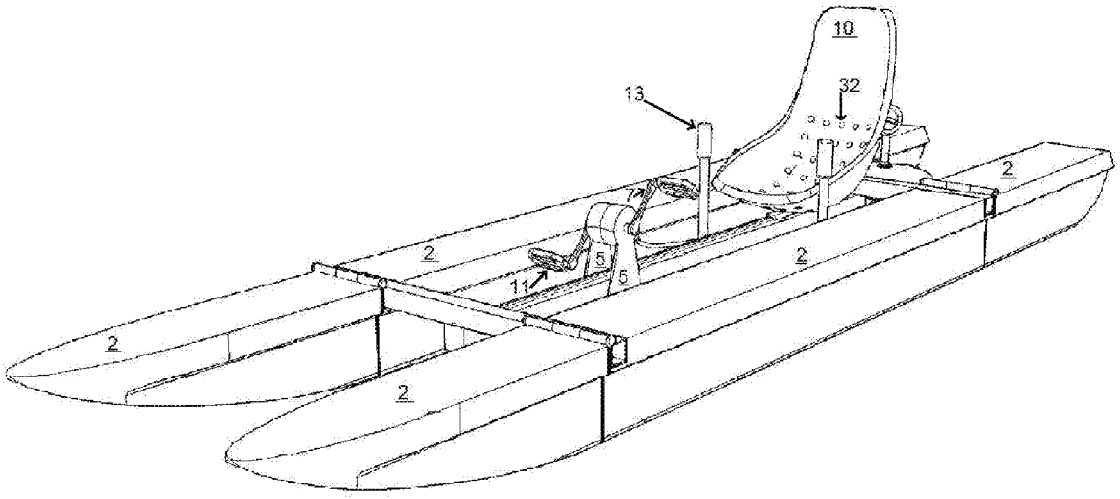
FIG. 22 shows a view of the foot-powered embodiment of the invention from below.

FIG. 22 shows the foot-powered embodiment from a "bird's-eye" perspective of a viewer who is to the left of the embodiment. The seat (10) and the holes in the seat (32) can be clearly seen. The gear mount (5) and seat connection members (13) can be seen, and one of the seat connection members (13) is designated. The foot pedals (11) and pedal gears (7) are also designated.

Figure 23:
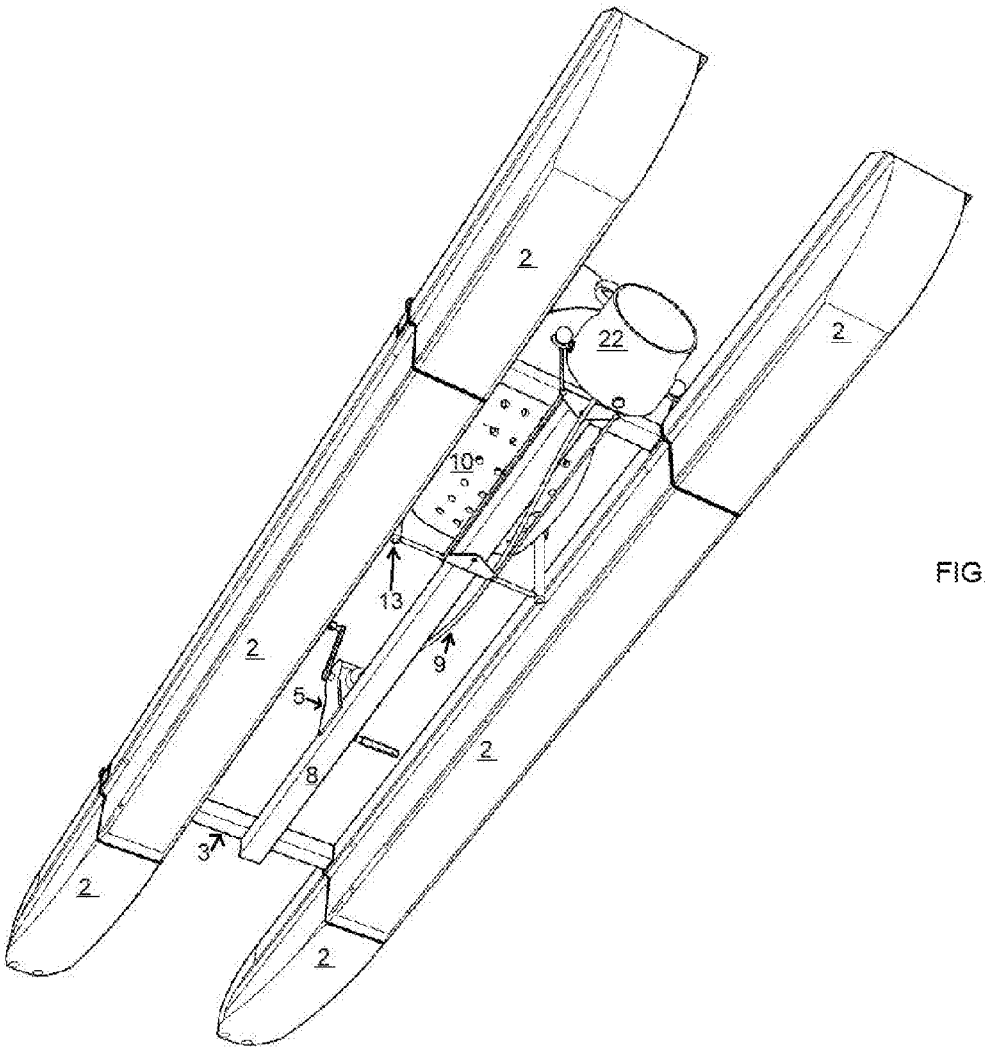
FIG. 23 shows a view of the foot-powered embodiment of the invention from below.

FIG. 23 shows a view of the foot-powered embodiment of the invention from below. The floating members (2) and middle beam (8) can be clearly seen. In between the floating members (2), the viewer can see the foot pedals (11), one of which is designated. The user can also see the gear mount (5) and differential (9). To the back of the embodiment, the viewer can see the Venturi pipe (22).

Figure 24:
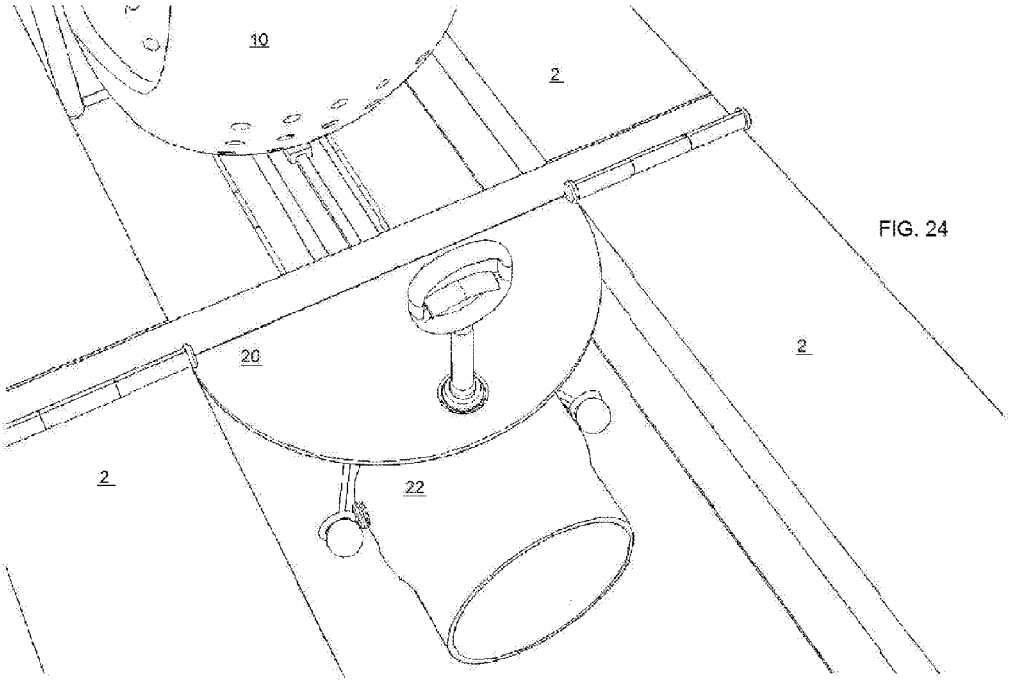
FIG. 24 shows a "close-up" of some of the components comprising the "Venturi Drive" of the foot-powered invention from above.

FIG. 24 shows a "close-up", magnified view of some of the components comprising the "Venturi Drive" of the foot-powered invention from above. Parts of both of the floating members (2) can be seen. The Venturi direction plate (20), and below it the Venturi pipe, are also visible. The seat (10) can also be seen.

Figure 25:
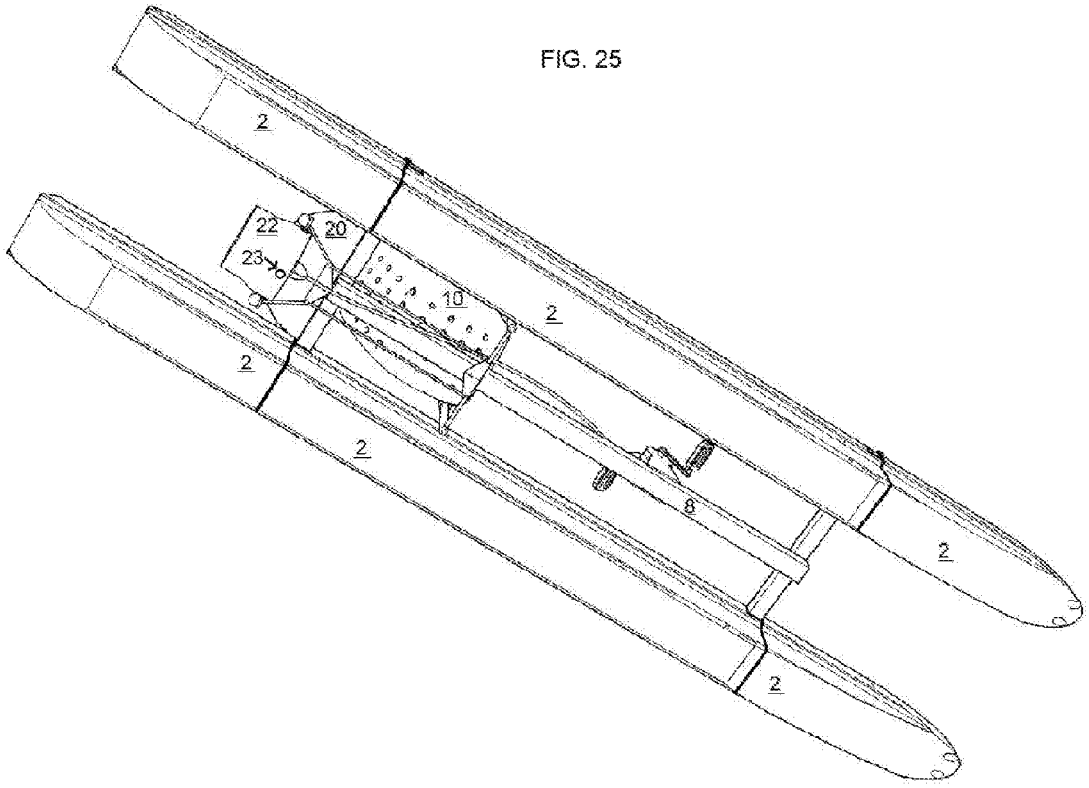
FIG. 25 shows another view of the foot-powered embodiment of the invention from below.

FIG. 25 shows another view of the foot-powered embodiment of the invention from below. Here the pipe stabilization bolt (23) can be seen on the bottom of the Venturi pipe (22).

Figure 26:
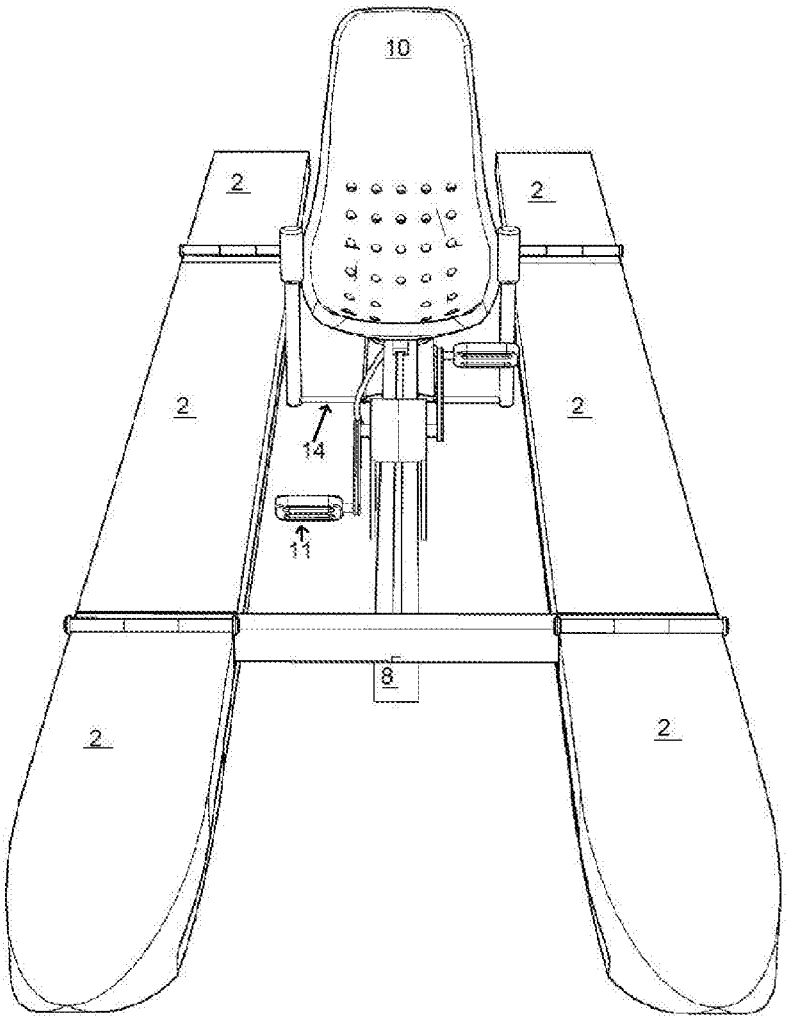
FIG. 26 shows a "bird's-eye" view of the foot-powered embodiment of the invention, from the perspective of an observer who is above, and in front of, the embodiment.

FIG. 26 shows a "bird's-eye" view of the foot-powered embodiment of the invention, from the perspective of an observer who is above, and in front of, the embodiment. The foot pedals (11) are visible, and clearly designated, between the floating members (2). The seat (10) is also clearly visible. The seat struts (14) can also be seen.

Figure 27:
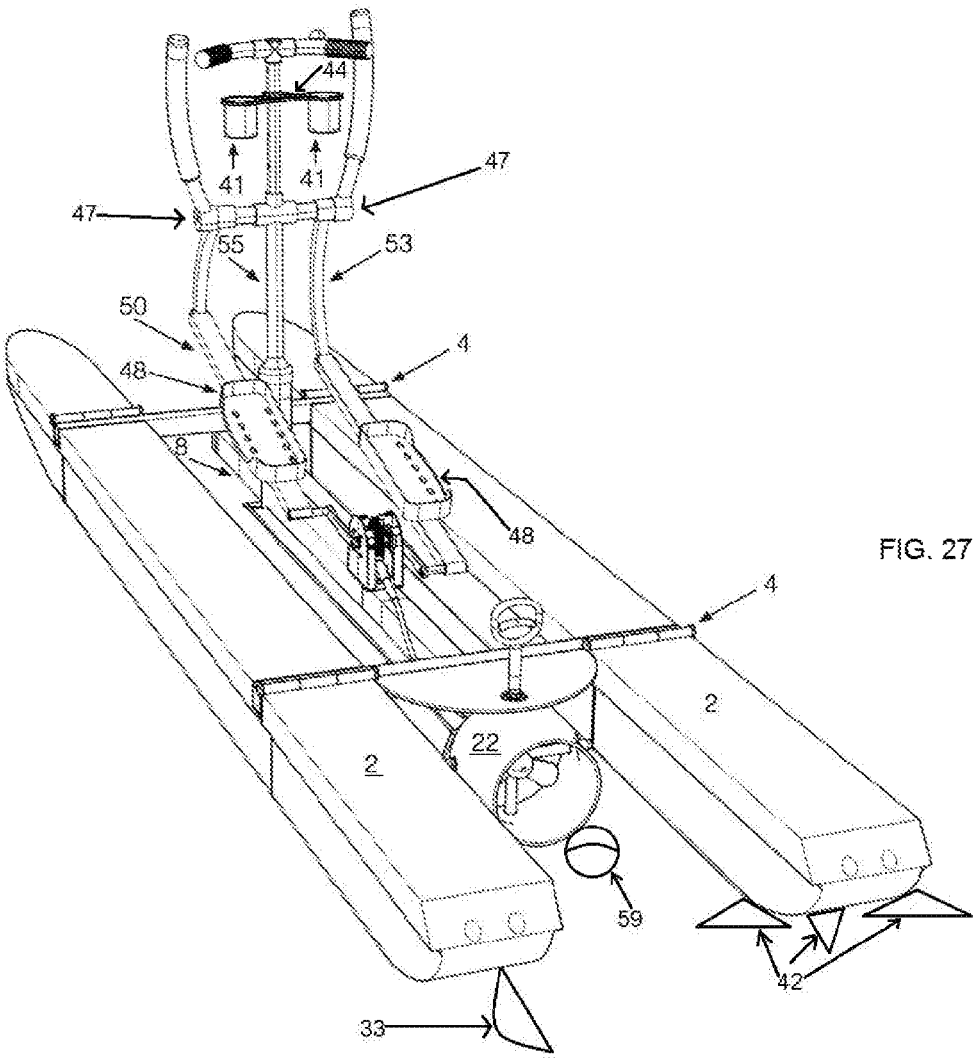
FIG. 27 shows another view of the preferred embodiment from a side perspective.

FIG. 27 shows another view of the preferred embodiment from a side perspective. The motor (59), fins (42), and retractable rudder (33) are attached to this particular embodiment. In addition, the cupholder support bar (44) is designated.

Figure 28:
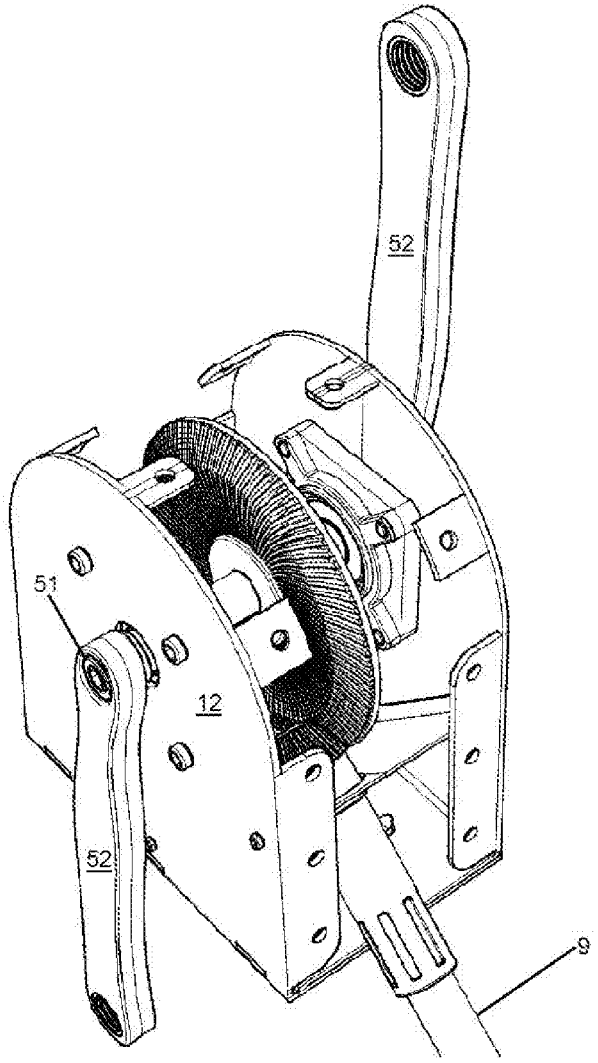
FIG. 28 shows a "close-up" picture of the gear system (12), flexible drive shaft (9) and some of the nearby components.

FIG. 28 shows a "close-up" picture of one version of the gear system (12), flexible drive shaft (9) and some of the nearby components. Both of the lower system connection members (52) have been designated, and the relationship between one of the lower system connection members (52) and one of the secondary pivot pegs (51) can clearly be seen. When the lower system connection member (52) moves, it imparts energy to the secondary pivot peg (51), which then transmits this energy into the gear system (12). Parts of one of the foot platform mounts (50) are visible. Many of the nearby components are not shown in this figure, so that the viewer can focus on the gear system and flexible drive shaft.

The invention claimed is:

1. A human-powered watercraft comprising the following components;

a "group of components that comprise a Venturi Drive"; and two or more floating members (2); and a differential gear system (12); a means through which motive power can be provided to said gear system (12); and a flexible drive shaft (9); said "group of components that comprise the Venturi Drive" further comprising; one or more propellers (29); a Venturi pipe (22); a drive direction pillar (28); and a plate;

where said plate is placed horizontally and has a hole through which said drive direction pillar (28) can fit, and can rotate while fitting through;

where said Venturi pipe (22) is hollow and contains a hole in its top, which is its closest part to said plate, and another hole in its bottom, which is its part furthest away from said plate, where said drive direction pillar (28) is capable of fitting through both holes, and where said Venturi pipe (22) also contains a horizontal opening on each of its horizontal ends, and the larger of said horizontal openings is the end closer to said gear system (12) and has a greater diameter than the smaller of said horizontal openings;

where said drive direction pillar (28) is round and fits through a hole in said plate; and through the hole in the top of said Venturi pipe (22), and through the other hole in the bottom of said Venturi pipe (22);

where the diameter of said Venturi pipe (22) gradually decreases between the larger horizontal opening and the smaller horizontal opening;

where said propeller (29) is located inside said Venturi pipe (22); and drives water from said larger horizontal opening in said Venturi pipe (22) to said smaller horizontal opening in said Venturi pipe (22);

where said means by which motive power can be provided to said gear system comprises foot platforms (48) which can move in response to motive pressure placed on said foot platforms, and which are connected to said gear system (12) in a way that motive pressure placed on said foot platforms (48) can cause said foot platforms to move, which will transmit said motive power to said gear system (12); and also vertical handlebar grips (49) which are capable of either partially or fully rotating, and which are connected to said gear system (12) so that when motive power is placed upon said vertical handlebar grips (49) this motive power is transmitted to said gear system (12); so that said gear system transmits this motive power to said flexible drive shaft;

where said gear system (12) connects to and transmits motive power to said flexible drive shaft (9);

where said flexible drive shaft (9) connects to and transmits motive power to said propeller (29); causing said propeller (29) to turn.

2. The human-powered watercraft of claim 1 further comprising a drive direction control (24) placed on top of, and attached to, the drive direction pillar (28);

where said drive direction control (24) allows the user to turn said drive direction pillar (28) by turning said drive direction control (24);

and further comprising that when said drive direction pillar (28) turns it forces said Venturi pipe (22) and said propeller (29) to also turn, thus changing the direction in which said propeller (29) will propel the watercraft.

3. The human-powered watercraft of claim 2 further comprising that a pipe stabilization pillar (21) is located midway between the top and the bottom of said Venturi pipe (22), and fits through two holes in said Venturi pipe (22) which are on the left side and the right side of said Venturi pipe; that said pipe stabilization pillar is perpendicular to said drive direction pillar (28) and that said Venturi pipe (22) includes a hole on its left side, and a hole on its right side, so that said pipe stabilization pillar (21) fits through both the holes on the left side and the right side of said Venturi pipe (22).

4. The human-powered watercraft of claim 3 further comprising connecting members (3) that connect said floating members (2) and are perpendicular to said floating members (2); and a middle beam (8) that connects said connecting members (3), and is located in between said floating members (2) and is perpendicular to said connecting members (3) and parallel to said floating members (2).

5. The human-powered watercraft of claim 2 further comprising drive stabilization links (57) that connect said Venturi pipe (22) to a small plate (56); and drive stabilization struts (26) that further connect said small plate (56) to said middle beam (8).

6. The human-powered watercraft of claim 5 further comprising a pipe stabilization bolt (23) which is placed on the lower end of said drive direction pillar (28) which is the end furthest below said plate and below the lowest part of said Venturi pipe (22) which is the part furthest below said plate.

7. The human-powered watercraft of claim 6 further comprising two foot platforms (48) and two foot platform mounts (50);

where each of said foot platforms (48) is mounted on one of said foot platform mounts (50);

and where said foot platform mounts (50) are connected to said gear system (12) in a way that allows said foot platform mounts (50) to rotate, and, by rotating, to transmit motive power to said gear system (12); so that said gear system (12) then transmits said motive power to said flexible drive shaft (9).

8. The human-powered watercraft of claim 7 further comprising two vertical handlebar grips (49); two upper flexible couplings (46) and two lower flexible couplings (47); and two coupling connectors (53) wherein each of said vertical handlebar grips (49) is attached to one of said upper flexible couplings (46), each of said upper flexible couplings (46) is attached to one of said coupling connectors (53) and each of said coupling connectors (53) is attached to one of said lower flexible couplings (47); and where each of said lower flexible couplings (47) is attached to one of said foot platform mounts (50);

where the user may push on said vertical handlebar grips (49), thus imparting motive power to said vertical handlebar grips (49) and causing them to rotate around said upper flexible coupling (46);

where motive power imparted to said vertical handlebar grips (49) is transmitted via said upper flexible coupling (46) to said coupling connector (53), causing said coupling connector (53) to move, and causing motive power to be transmitted from said coupling connector (53) to said lower flexible coupling (47); and from said lower flexible coupling (47) to said foot platform mounts (50), causing said foot platform mounts (50) to move.

9. The human-powered watercraft of claim 8 further comprising a steering support base (54) and steering support pole (55), where said steering support pole (55) is connected to each of said upper flexible couplings (46).

10. The human-powered watercraft of claim 9 further comprising one or more horizontal handlebar grips (37) which the user can grip with his hands.

11. The human-powered watercraft of claim 10 further comprising one or more bells (43) mounted on said horizontal handlebar grip (37).

12. The human-powered watercraft of claim 9 further comprising a cupholder support bar (44) and one or more cupholders (41) which fit into said cupholder support bar (44).

13. The watercraft of claim 5; further comprising junction members (4) that are on top of said floating members (2) and connect to said connecting members (3).

14. A method of providing motive power for a human-powered watercraft by pressing down on a foot platform (48) attached to a foot platform mount (50); which is connected to a lower system connection member (52); which then rotates in response to the pressure, and which is connected to a gear system (12); where said lower system connection member (52) causes the gears in said gear system (12) to turn, causing a flexible drive shaft (9) connected to said gear system (12) to move; where said flexible drive shaft (9) is connected to a Venturi pipe (22) which is a part of a Venturi Drive, said Venturi Drive further comprising; one or more propellers (29); a Venturi pipe (22); a drive direction pillar (28); and a plate;

where said plate is placed horizontally and has a hole through which said drive direction pillar (28) can fit, and can rotate while fitting through;

where said drive direction pillar (28) is round and fits through a hole in said plate; and through a hole in the top of said Venturi pipe (22) which is the part of said Venturi pipe (22) closest to said plate, and through another hole in the bottom of said Venturi pipe (22); which is the part of said Venturi pipe (22) furthest away from said plate, where said Venturi pipe (22) contains a hole on its top and another hole in its bottom through which said drive direction pillar (28) is capable of fitting, and also contains an opening on each of its horizontal ends, and the larger of said openings which is the opening closer to said gear system has a greater diameter than the smaller of said openings which is the opening further away from said gear system;

where the diameter of said Venturi pipe (22) gradually decreases between the larger opening and the smaller opening;

where said propeller (29) is located inside said Venturi pipe (22); and drives water from said larger opening in said Venturi pipe (22) to said smaller opening in said Venturi pipe (22);

where said flexible drive shaft (9) connects to and transmits motive power to said propeller (29); causing said propeller (29) to turn and move the watercraft.

* * * * *